US009048545B2

(12) United States Patent
Emmanuel et al.

(10) Patent No.: US 9,048,545 B2
(45) Date of Patent: Jun. 2, 2015

(54) ENHANCED HIGH EFFICIENCY 3G/4G/LTE ANTENNAS, DEVICES AND ASSOCIATED PROCESSES

(71) Applicant: NETGEAR, INC., San Jose, CA (US)

(72) Inventors: Joseph Amalan Arul Emmanuel, Cupertino, CA (US); Chia-Wei Liu, Fremont, CA (US)

(73) Assignee: NETGEAR, INC., San Jose, CA (US)

( * ) Notice: Subject to any disclaimer, the term of this patent is extended or adjusted under 35 U.S.C. 154(b) by 264 days.

(21) Appl. No.: 13/830,018

(22) Filed: Mar. 14, 2013

(65) Prior Publication Data

US 2014/0266936 A1 Sep. 18, 2014

(51) Int. Cl.

| | |
|---|---|
| ***H01Q 21/00*** | (2006.01) |
| ***H01Q 9/42*** | (2006.01) |
| ***H01Q 5/00*** | (2006.01) |

(52) U.S. Cl.

CPC ..... *H01Q 9/42* (2013.01); *H01Q 5/0065* (2013.01)

(58) Field of Classification Search

CPC . H01Q 5/0024; H01Q 5/0062; H01Q 5/0065; H01Q 9/42; H01Q 21/30

USPC ..... 343/725, 700 MS, 702

See application file for complete search history.

(56) References Cited

U.S. PATENT DOCUMENTS

| | | | | |
|---|---|---|---|---|
| 7,518,555 | B2 * | 4/2009 | Heng et al. | 343/700 MS |
| 8,749,448 | B2 * | 6/2014 | Tsou et al. | 343/876 |

OTHER PUBLICATIONS

Chang, Cheng-Wei et al., "A novel design of the internal eithg-band mobile phone antenna with a tuning element", International Symposium on Antennas and Propagation, Oct. 28, 2011, 4 pages.

* cited by examiner

*Primary Examiner* — Hoang V Nguyen

(74) *Attorney, Agent, or Firm* — Michael A. Glenn; Perkins Coie LLP

(57) ABSTRACT

Embodiments of the invention provide several antenna designs that exhibit both high bandwidth and efficiency, such as for operation in one or more bands, such as but not limited to operation in 3G, 4G, LTE bands. A first aspect of the invention concerns the form factor of the enhanced antenna; a second aspect of the invention concerns the ease with which the enhanced antenna is manufactured; and a third aspect concerns the superior performance exhibited by the enhanced antenna across one or more bandwidths.

30 Claims, 35 Drawing Sheets

Simulated Performance XY Plane (f=850 MHz) (700-1000 MHz)

Simulated Performance
XY Plane
(f=850 MHz)
(700-1000 MHz)

ENHANCED HIGH EFFICIENCY 3G/4G/LTE ANTENNAS, DEVICES AND ASSOCIATED PROCESSES

BACKGROUND OF THE INVENTION

1. Technical Field

The invention relates generally to antennas for wireless or RF (radio frequency) communications systems. More particularly, the invention relates to antenna designs that provide both high bandwidth and efficiency.

2. Description of the Background Art

It is necessary to equip receivers, transmitters, and transceivers with antennas that efficiently radiate, i.e. transmit and/or receive desired signals to/from other elements of a network to provide wireless connectivity and communication between devices in a wireless network, such as in a wireless PAN (personal area network), a wireless LAN (local area network) a wireless WAN (wide area network), a cellular network, or virtually any other radio network or system. For such antennas as are used in, for example, the 2.4 GHz and 5.0 GHz bands, it is a challenge to provide an antenna that exhibits high efficiency and that is easy to manufacture.

SUMMARY OF THE INVENTION

Embodiments of the invention provide several antenna designs that exhibit both high bandwidth and efficiency, such as for operation in one or more bands, such as but not limited to operation in 3G, 4G, LTE bands. A first aspect of the invention concerns the form factor of the enhanced antenna; a second aspect of the invention concerns the ease with which the enhanced antenna is manufactured; and a third aspect concerns the superior performance exhibited by the enhanced antenna across one or more bandwidths.

DETAILED DESCRIPTION OF THE INVENTION

Figure 1:
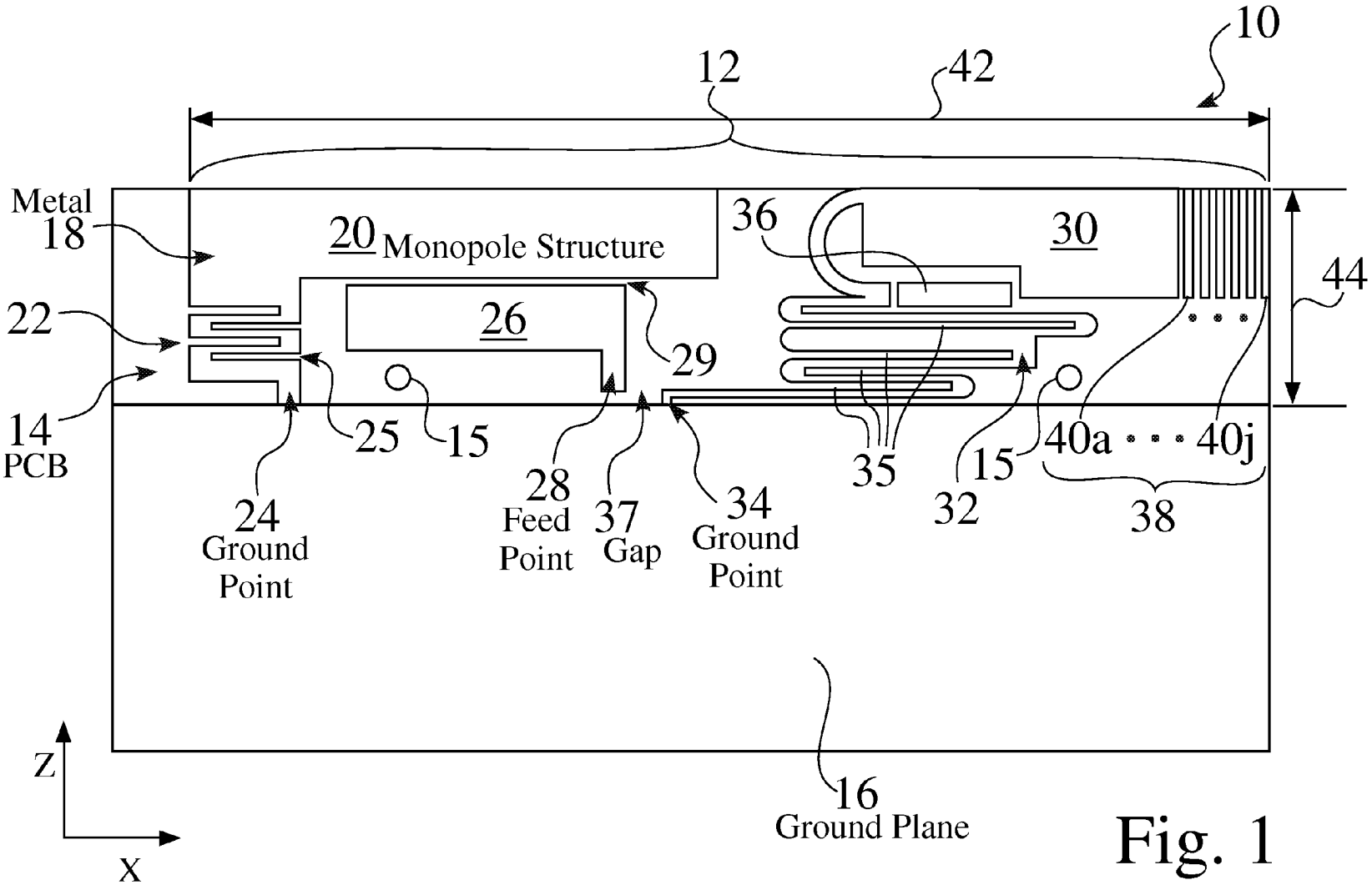
FIG. 1 is a top plan view of an exemplary enhanced on board PCB antenna; such as for operation within a 740 MHz to 960 MHz band and/or a 1,700 MHz to 2700 MHz band.

FIG. 1 is a top plan view 10 of an exemplary enhanced on board PCB antenna 12 such as for operation within a 740 MHz to 960 MHz band, and/or a 1,700 MHz to 2700 MHz band. The exemplary enhanced on board PCB antenna 12 seen in FIG. 1 provides a voltage standing wave ratio (VSWR) of less than about 3 to 1 at frequencies below 1,000 MHz, and a voltage standing wave ratio (VSWR) of less than about 2.5 to 1 at frequencies above 1,000 MHz.

The exemplary enhanced on board PCB antenna 12 seen in FIG. 1 comprises a metal layer that 14 is formed in a single layer printed circuit board (PCB) 14 having, in this case, a width 44 of 16 mm, a length 42 of 73 mm, and a thickness of 1.6 mm, although other dimensions may be used. In the example shown, the exemplary enhanced on board PCB antenna 12 has a footprint of about 1,168 $mm^2$, such that it may readily be integrated with a wide variety of small devices, such as but not limited to routers, cell phones, smart phones, gaming devices, portable computers, or any combination thereof.

One or more drilled holes 15 may preferably be provided to mount the antenna. In this embodiment, the holes have a 2 mm diameter, although other diameters may be used. The antenna 12 is connected to a respective system, e.g. device 700 (FIG. 33) or 720 (FIG. 34) by an antenna cable at a cable soldering area, such as at a feed point 28 and/or ground points 24.34.

The enhanced on board PCB antenna 12 seen in FIG. 1 comprises a first electrically conductive monopole structure 20, such as for operation in an 800 MHz frequency band. An electrically conductive trace 22 extends from the monopole structure 20 to a ground point 24, thus forming a meander line 22, which allows miniaturization of the antenna 12. One or more gaps 25 are defined by the electrically conductive trace 22, which may preferably allow tuning for any of inductance or capacitance. In a current embodiment of the antenna 12, one or more gaps 25 of about 0.5 mm are provided, although other gaps may preferably be used.

While FIG. 1 shows an exemplary geometry for the meander line 22, it should be understood that other geometries, shapes, and dimensions may preferably be chosen to meet the desired performance of the enhanced antenna 12. For example, the path and curvature of the meander line 22 may preferably be configured to increase the current path, and/or lower the antenna resonate frequency. As well, one or more gaps 25 may be configured in the meander line 22 to maintain a stable antenna impedance and reactance for 800 MHz band. While the exemplary monopole structure 20 shown in FIG. 1 has a 0.5 mm gap 25, other gap dimensions may be used in other embodiments.

The enhanced on board PCB antenna 12 seen in FIG. 1 also comprises an electrically conductive L-shaped monopole antenna 26, such as for operation in a 2.5 GHz to 2.7 GHz frequency band. The L-shaped monopole antenna 26 extends to a feed point 28. As seen in FIG. 1, a slot 29 is defined between the first monopole structure 20 and the second L-shaped monopole structure 26, wherein the slot 29 provides resonance for the 1.7 to 2.2 GHz band.

The enhanced on board PCB antenna 12 seen in FIG. 1 further comprises a third electrically conductive monopole structure 30, such as for operation in a 700 MHz frequency band. An electrically conductive trace 32 extends from the monopole structure 30 to a ground point 34, and forms a meander line, which similarly allows miniaturization of the antenna 12. One or more gaps 35 are defined by the electrically conductive trace 32, which may preferably allow tuning for any of inductance or capacitance. In a current embodiment of the antenna 12, one or more gaps 35 of about 0.5 mm are provided, although other gaps may preferably be used.

While FIG. 1 shows an exemplary geometry for the meander line 32, it should be understood that other geometries, shapes, and dimensions may preferably be chosen to meet the desired performance of the enhanced antenna 12. For example, the path and curvature of the meander line 32 may preferably be configured to increase the current path, and/or lower the antenna resonate frequency. As well, one or more gaps 35 may be configured to maintain a stable antenna impedance and reactance for 700 MHz band. While the exemplary monopole structure 30 shown in FIG. 1 has a 0.5 mm gap 35, other gap dimensions may be used in other embodiments.

As also seen in FIG. 1, a gap 37 is defined between the L-shaped monopole antenna 26, e.g. such as at the feed point 28, and the electrically conductive trace 32, such as at or near the ground point 34. The gap 37 is preferably defined to create adjunction resonance at 700 Hz to 800 MHz.

Additional structures may preferably be provided for the enhanced on board PCB antenna 12, such as for post-production tuning or for other applications. For example, as seen in FIG. 1, one or more electrically conductive regions 36 and/or 38 may be established on the PCB 14. As well a tuning region 38 may comprise one or more slots 40, e.g. 40*a*-40*j*, wherein the slots may controllably be modified or removed, e.g. mechanically or by etching, to tune the performance of the assembly.

Some embodiments of the enhanced antenna 12 may preferably be configured to provide an omnidirectional radiation pattern from and S11 of less than −6 dB from 740 MHz-960 MHz, 1700 MHz-2700 MHz. For purposes of the discussion herein, S11 represents how much power is reflected from the enhanced antenna 12. If S11 is equal to 0 dB, then all the power is reflected from the enhanced antenna 12, and nothing is radiated. If S11 is equal to −10 dB, this implies that if 3 dB of power is delivered to the enhanced antenna 12, −7 dB is the reflected power. The rest of the power was accepted by the enhanced antenna 12. This accepted power is either radiated or absorbed as losses within such an exemplary antenna. Because enhanced antennas 12 are typically designed to be low loss, the majority of the power delivered to the enhanced antenna 12 is radiated.

Embodiments of the invention provide several antenna designs that exhibit both high bandwidth and efficiency. As discussed below in greater detail, a first aspect of the invention concerns the form factor of the enhanced antenna 12 (FIG. 1); a second aspect of the invention concerns the ease with which the enhanced antenna 12 is manufactured; and a third aspect concerns the superior performance that the enhanced antenna 12 exhibits across a one or more bandwidths, e.g. multi-resonant performance.

The enhanced antenna 12 provides superior performance at 2,000 MHz to 2,300 MHz and, as described above, may preferably comprise one or more features through which the enhanced antenna 12 may readily be fine-tuned. As well, the enhanced antenna 12 described herein does not require a fixed size ground plane. Furthermore, the enhanced antenna 12 doesn't require grounding to a common point, which provides easier adjustment of antenna performance between 700 MHz and 1,000 MHz.

Those skilled in the art will appreciate that other features of the invention contribute to the art and are thus new and unobvious, and that the discussion herein is not intended to limit the scope of the invention in any way. The foregoing key aspects of the invention are discussed overall in greater detail below. Thereafter, several specific embodiments of the herein disclosed invention are described.

Form Factor.

Embodiments of the invention allow for the production of an enhanced antenna 12 having a small form factor that, at the same time, exhibits exceptional performance. The size of the enhanced antenna 12 is often critical, because such products as routers and the like can use a minimum of four to six antennas. In such applications, the size of the enhanced antenna 12 plays a huge role. If the antenna size is big, it is not possible to accommodate 2 (there are two antennas in one unit) antennae in one particular product.

The herein disclosed enhanced antenna 12 is readily manufactured in any required form factor. For example, the enhanced antenna 12 may preferably be manufactured for internal installation within a device, such as a router, or it can be manufactured for external installation within a housing, for example as a remote antenna. In either application, the enhanced antenna 12 may be fabricated identically. Thus, it is not necessary to maintain an inventory of enhanced antennas 12 for separate applications. Rather, the only need of an inventory is that which contains enhanced antennas 12 for each desired band or combination of bands. In all other aspects, the enhanced antennas 12 herein disclosed can be universally applied.

Manufacturability.

The exemplary enhanced antenna 12 seen in FIG. 1 is formed as a conductive, e.g. metallic, pattern on a printed circuit board (PCB) 14 or similar substrate 14. Uniquely, the formation of the antenna elements in this fashion provides reliable performance a wide bandwidth. The enhanced antenna 12 is easy to manufacture because it may preferably be formed as a single layer on a PCB substrate 14. Thus, while the state of the art comprises multilayer antennas that need a feed through and, thus a high cost, precision PC manufacturer, an enhanced antenna 12 manufactured according to the invention may preferably be formed on a single layer PCB 14 (although embodiments of the enhanced antenna 12 may alternately be formed on multi-layer PCBs, if desired).

Accordingly, the enhanced antenna 12 disclosed herein may preferably be readily made by any manufacturer having basic PCB fabricating facilities. Because such manufacture is relatively low tech, antenna yields, cost of manufacture, the use of commonly available materials and equipment, and the like all contribute to a low cost, high quality antenna 12. Thus, conventional PCB and similar known manufacturing techniques can be readily used to produce large quantities of the enhanced antenna 12 with precision and at low cost.

Performance.

As disclosed herein, careful selection and design of the enhanced antenna 12 shapes provide resonance over a wide range of frequencies within a band, thus exhibiting broad bandwidth, while also providing excellent radiation performance. As such, an important part of the invention is the shape of the defined structures of the enhanced antenna 12.

The unique and specific perimeter shape of each antenna element increases the frequency of resonance of the enhanced antenna 12 across a wide band, thus making the enhanced antenna 12 well suited for communications in the 3G and LTE (700-960 MHz, 1700-2300 MHz, 2500-2700 MHz) bands. While the state of the art the perimeter shape of an antenna is typically a rectangle or square, which limits the tuning capability, the shapes of the herein disclosed enhanced antenna 12 gives the antenna wider band coverage.

As seen in FIG. 1, the third electrically conductive monopole structure 30 may preferably comprise several curves, such as associated with the electrically conductive trace 32 that extends from the monopole structure 30 to a ground point 34. The shape and configuration of the meander line may preferably be configured to make the antenna size smaller, and also to maintain the overall length of each element, such that the perimeter of each element from end to end may preferably comprises a quarter-wave ($\lambda/4$-wave) resonator. This arrangement provides the ability to increase the bandwidth because each bulge or curve in the antenna profile forms a quarter wave or one eighth of a wavelength that can extend the antenna bandwidth. That is, across the antennal structure there can be multiple resonant wavelengths because of the curves and protrusions in the shape of each antenna element. Thus, the periphery or perimeter of each antenna element resonates at a certain frequency. Because the shape is different across the surface of each antenna element it is possible to cover a wide band instead of a narrow band.

As noted above small gaps, e.g. 29, 37 may preferably be formed between some of the antenna elements, which increase the bandwidth of the enhanced antenna 12. Providing a small gap between two antenna elements adds a larger serial capacitance value and makes the dipole antenna a low Q resonator. With a low Q resonator, the antenna input impedance and reactance are more stable. Thus, the enhanced antenna 12 may preferably match to a 50-Ohm transmission line in a wider bandwidth.

Furthermore, the shape and/or projection and/or profile of various portions of each antenna element are selected to tune the frequency of the enhanced antenna 12. For example, if a triangle shape is added to one or more of the antenna elements, such a triangle can be cut slightly shorter, or it can be formed slightly longer to shift the frequency of the enhanced antenna 12, and thus fine-tune the enhanced antenna 12. Thus, when the layout for the antenna elements on the substrate 14 is performed, it is possible to fine-tune the enhanced antenna 12 by adjusting the shape of the antenna elements. After production of the enhanced antenna 12, the enhanced antenna 12 can be put on a test appliance, and the above-mentioned apertures can be drilled out to effect precise final fine-tuning of the enhanced antenna 12.

The following discussion provides a detailed discussion of various embodiments of the invention. Such discussion is provided to show examples of the invention, but it is not intended to limit the scope of the invention on any way. In each of the examples below, the PCB 14 may comprise, for example, glass reinforced epoxy laminated sheets (FR4), ceramic laminates, thermoset ceramic loaded plastic, liquid crystalline circuit material; and the antenna elements may be formed of, for example copper, aluminum, silver, gold, tin, or any alloy thereof.

Comparison of Simulated and Measured VSWR and S11 Performance.

Figure 2:
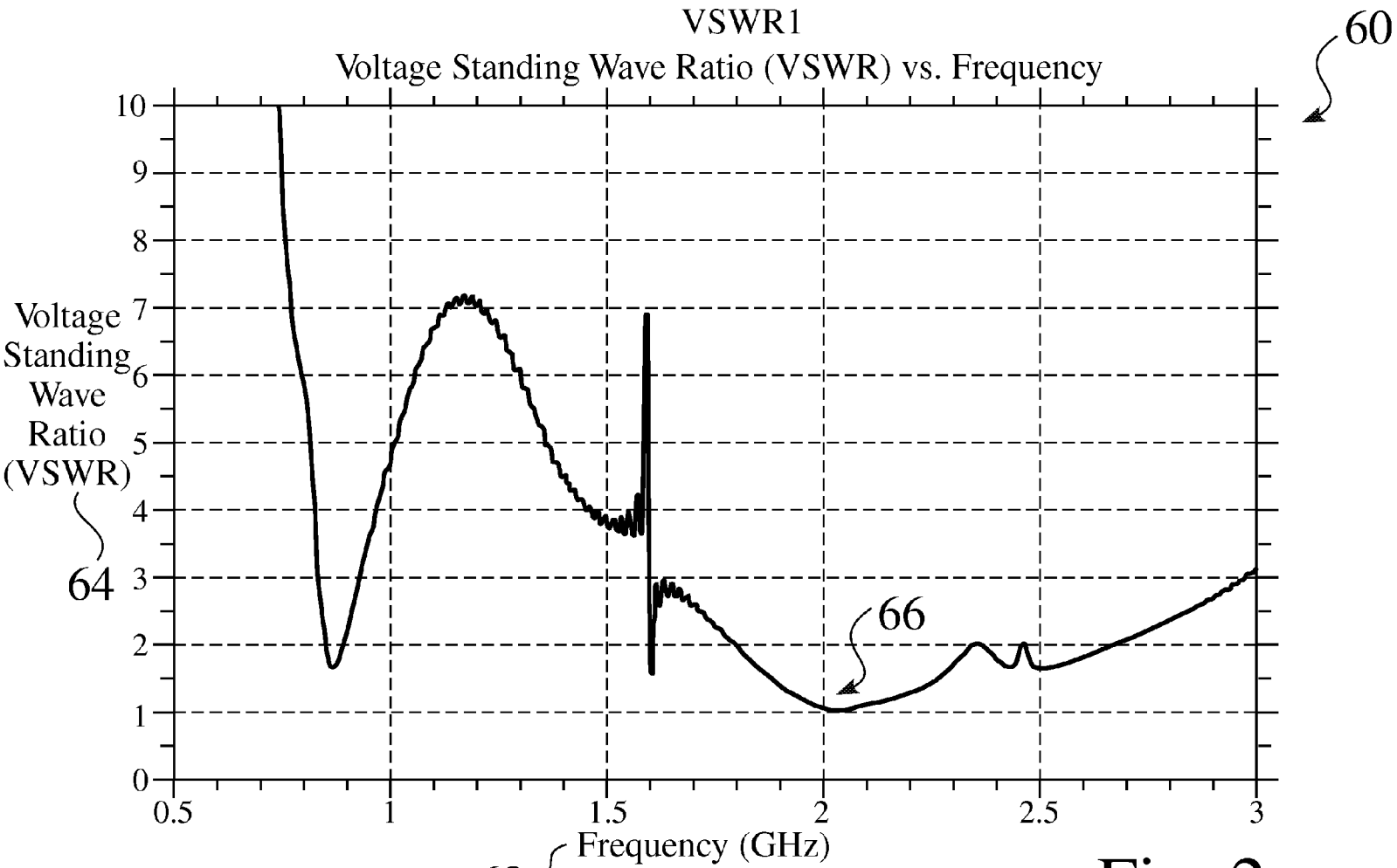
FIG. 2 shows a graph of simulated performance of voltage standing wave ratio (VSWR) as a function of frequency for an exemplary enhanced on board PCB antenna.
Figure 3:
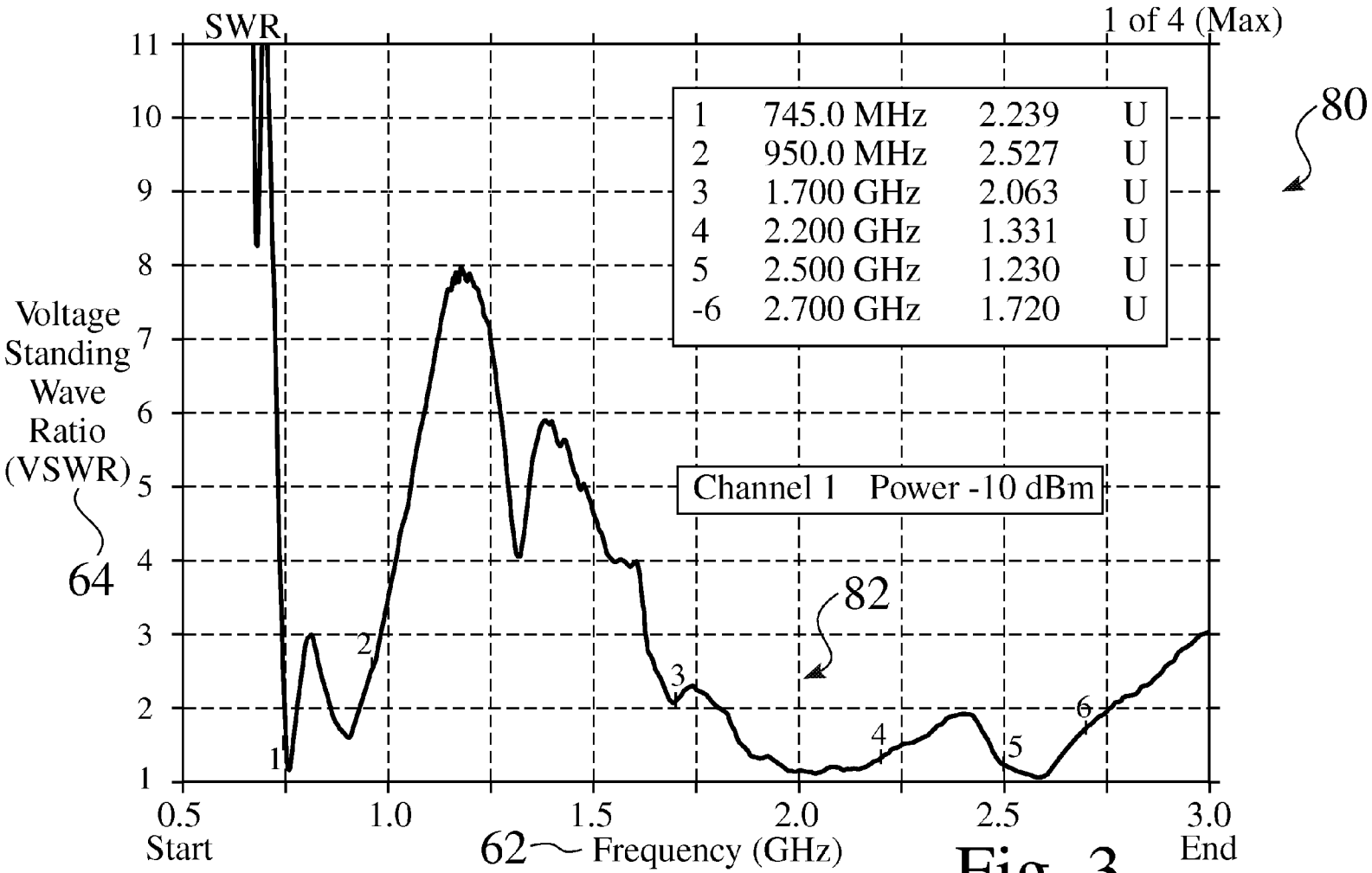
FIG. 3 shows a graph of the measured performance of voltage standing wave ratio (VSWR) as a function of frequency for an exemplary enhanced on board PCB antenna.

FIG. 2 shows a graph 60 of simulated performance 66 of voltage standing wave ratio (VSWR) 64 as a function of frequency 62 for an exemplary enhanced on board PCB antenna 12. FIG. 3 shows a graph 80 of the measured performance 88 of voltage standing wave ratio (VSWR) 64 as a function of frequency 62 for an exemplary enhanced on board PCB antenna 12.

As seen in FIG. 2 and FIG. 3, the enhanced on board PCB antenna 12 provides a voltage standing wave ratio (VSWR) of less than about 3 to 1 at frequencies below 1,000 MHz, and a voltage standing wave ratio (VSWR) of less than about 2.5 to 1 at frequencies above 1,000 MHz. For example, as seen in FIG. 3, data point 1 indicates a VSWR of 2.239, while data point 2 shows a VSWR of 2.527. As well, data points 3 through 6, corresponding to frequencies of 1.7 GHz, 2.2 GHz, 2.5 GHz, and 2.7 GHz, provide VSWR levels of 2.063, 1.331, 1.230 and 1.721, respectively.

Figure 4:
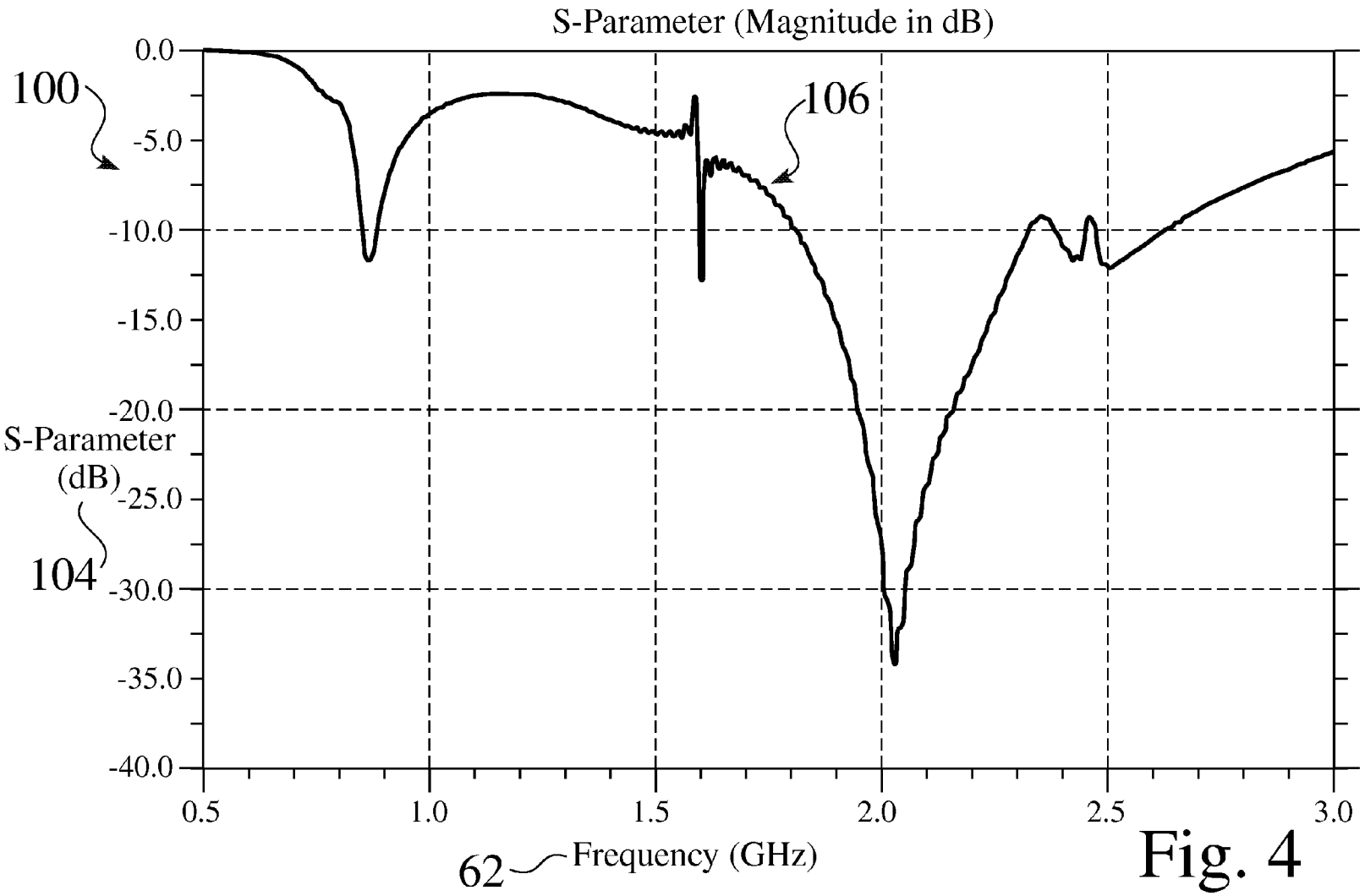
FIG. 4 shows a graph of simulated S-Parameter performance (Magnitude in dB) as a function of frequency for an exemplary enhanced on board PCB antenna.
Figure 5:
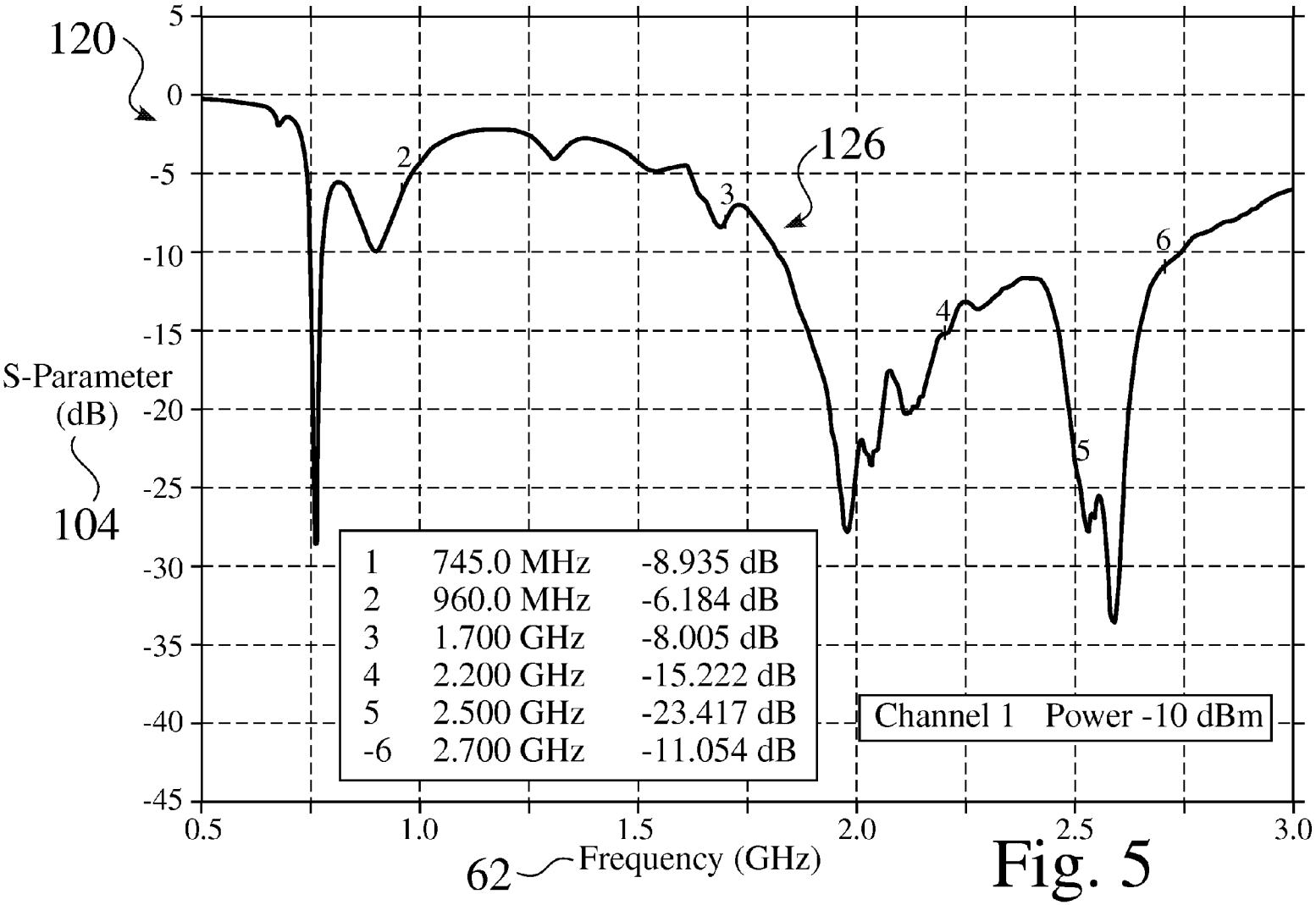
FIG. 5 shows a graph of measured S-Parameter performance (Magnitude in dB) as a function of frequency for an exemplary enhanced on board PCB antenna.

FIG. 4 shows a graph 100 of simulated 106 S-Parameter performance 104 as a function of frequency 62 for an exemplary enhanced on board PCB antenna 12. FIG. 5 shows a graph 120 of measured 126 S-Parameter performance 104 as a function of frequency 62 for an exemplary enhanced on board PCB antenna 12.

As seen in FIG. 4 and FIG. 5, the measure S-parameter performance 104 of the enhanced antenna 12 meets the design objectives for each of the desired frequencies of operation, wherein the majority of the power delivered to the enhanced antenna 12 is radiated.

Antenna Performance at 700 to 1000 MHz.

FIGS. 6-13 provide a series of graphs showing simulation data and measurement data for 700 MHz to 1,000 MHz band operation for the exemplary enhanced antenna 12 seen in FIG. 1. In particular, efficiency 142 and peak gain 162 are shown for the enhanced antenna 12, along with simulated and measured gain data with respect to XY plane (azimuth data), as well as XZ plane and YZ plane elevation data. As can be seen, actual measured values compare favorably with simulated values, thus confirming the merit of the antenna herein disclosed.

Figure 6:
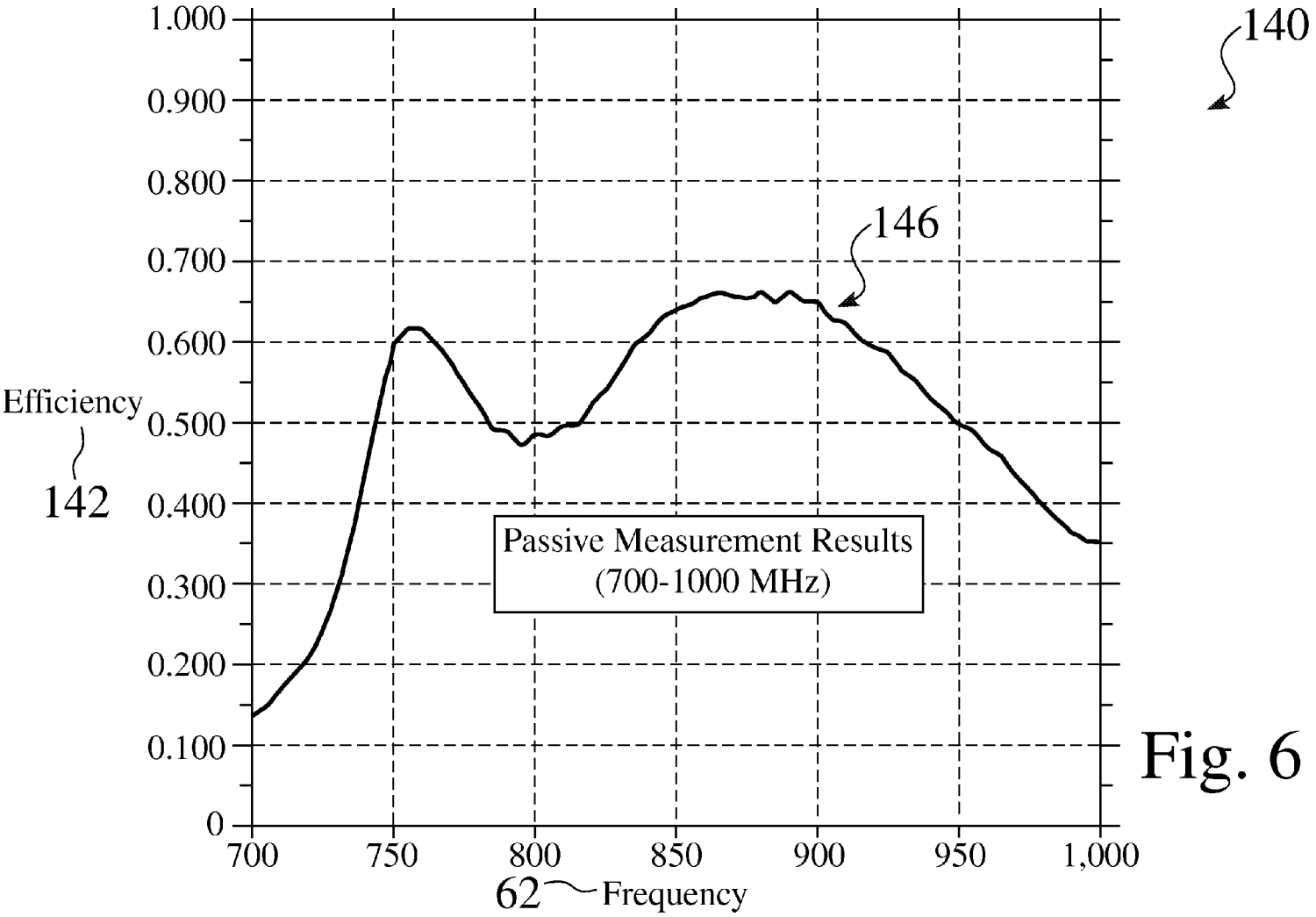
FIG. 6 is a graph showing passive measurement results of efficiency as a function of frequency for an exemplary enhanced on board PCB antenna operating at 700 MHz to 1,000 MHz.
Figure 7:
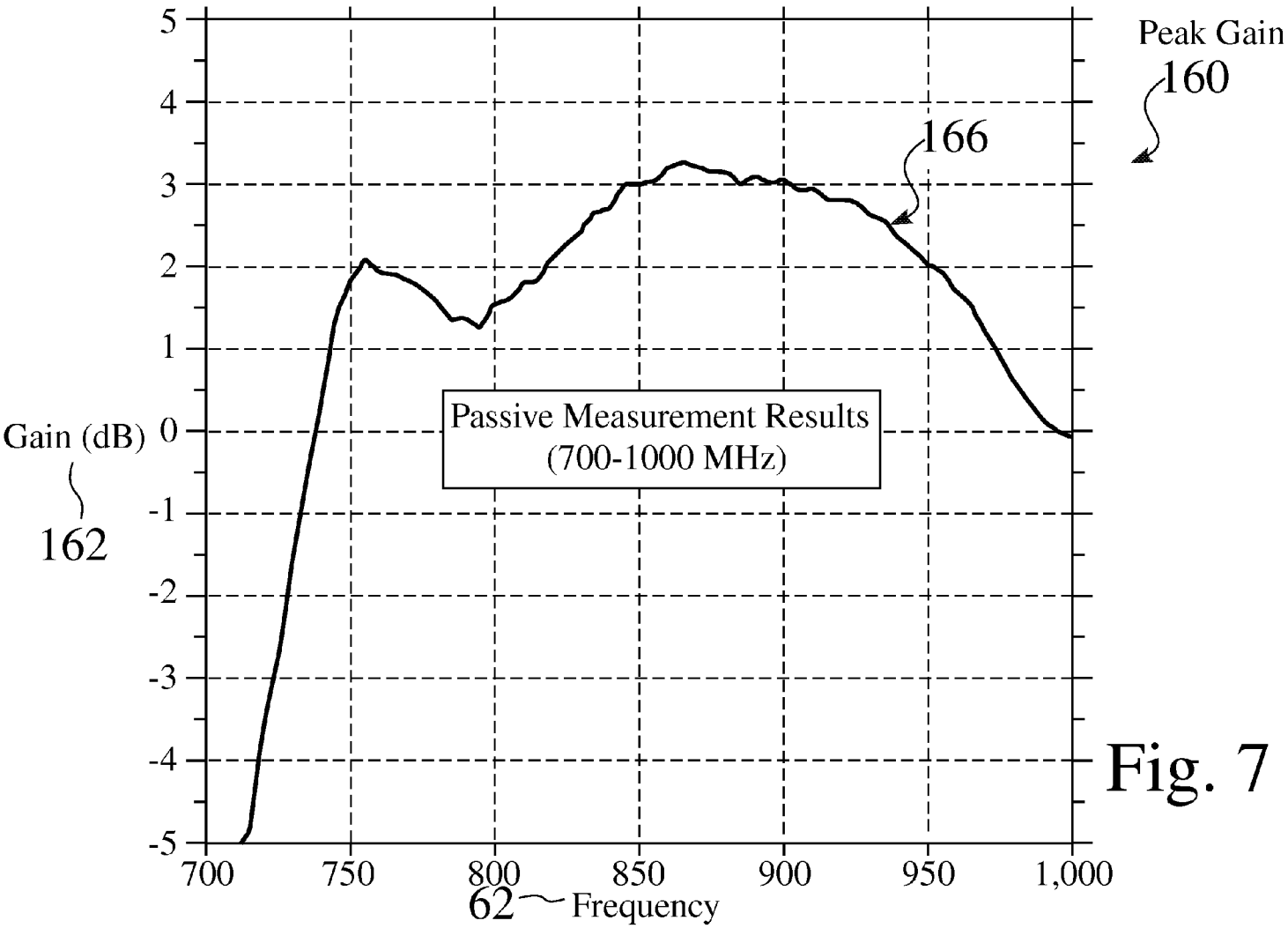
FIG. 7 is a graph showing passive measurement results of peak gain as a function of frequency for an exemplary enhanced on board PCB antenna operating at 700 MHz to 1,000 MHz.

FIG. 6 is a graph 140 showing passive measurement results 146 of efficiency 142 as a function of frequency 62 for an exemplary enhanced on board PCB antenna 12 operating at 700 MHz to 1,000 MHz. FIG. 7 is a graph 160 showing passive measurement results 166 of peak gain 162 as a function of frequency 62 for an exemplary enhanced on board PCB antenna 12 operating at 700 MHz to 1,000 MHz.

Figure 8:
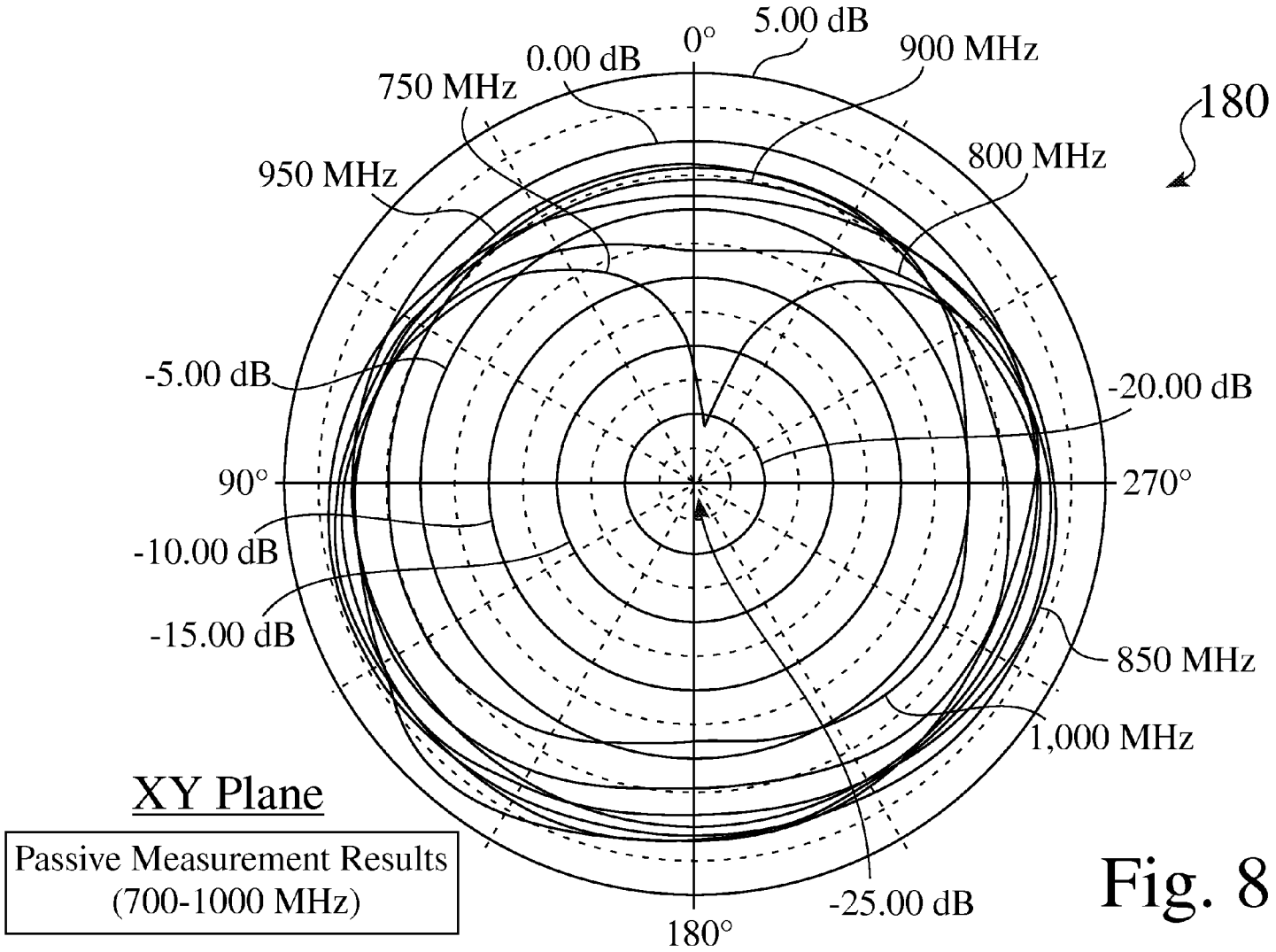
FIG. 8 is a graph showing XY Plane passive measurement performance for an exemplary enhanced on board PCB antenna operating at 700 MHz to 1,000 MHz.
Figure 9:
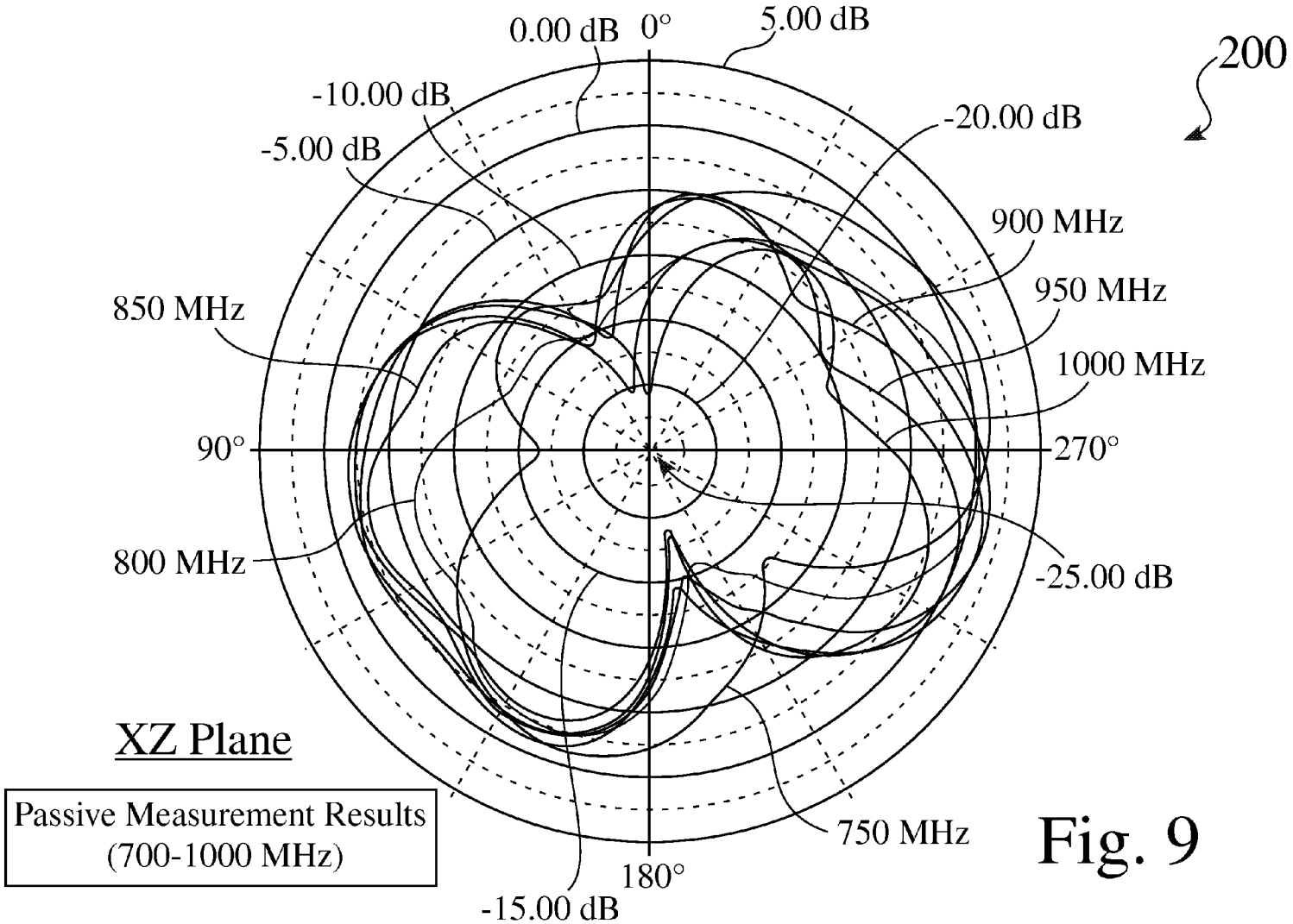
FIG. 9 is a graph showing XZ Plane passive measurement performance for an exemplary enhanced on board PCB antenna operating at 700 MHz to 1,000 MHz.
Figure 10:
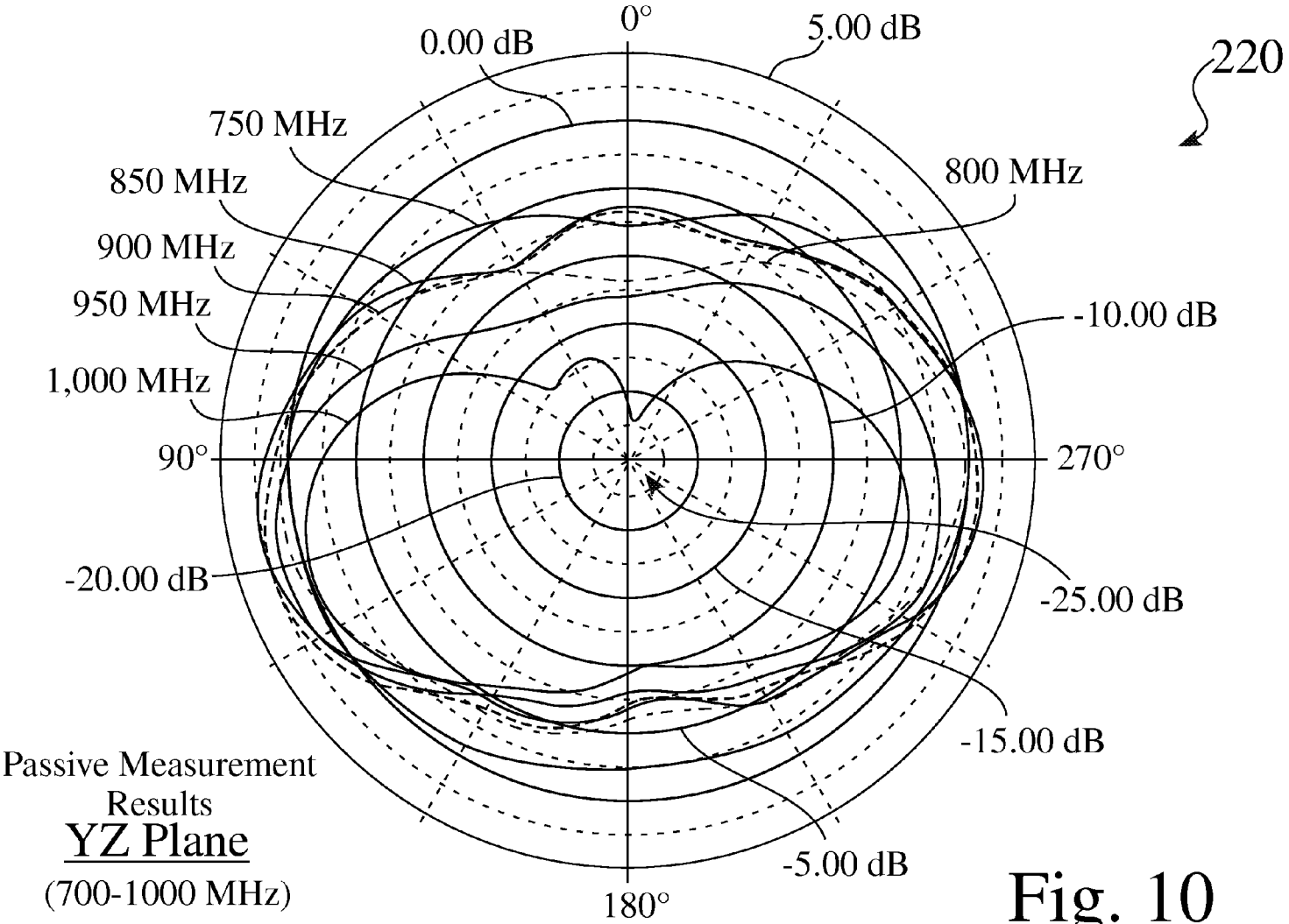
FIG. 10 is a graph showing YZ Plane passive measurement performance for an exemplary enhanced on board PCB antenna operating at 700 MHz to 1,000 MHz.

FIG. 8 is a graph 180 showing XY Plane passive measurement performance for an exemplary enhanced on board PCB antenna 12 operating at 700 MHz to 1,000 MHz. FIG. 9 is a graph 200 showing XZ Plane passive measurement performance for an exemplary enhanced on board PCB antenna 12 operating at 700 MHz to 1,000 MHz. FIG. 10 is a graph 220 showing YZ Plane passive measurement performance for an exemplary enhanced on board PCB antenna 12 operating at 700 MHz to 1,000 MHz.

Figure 11:
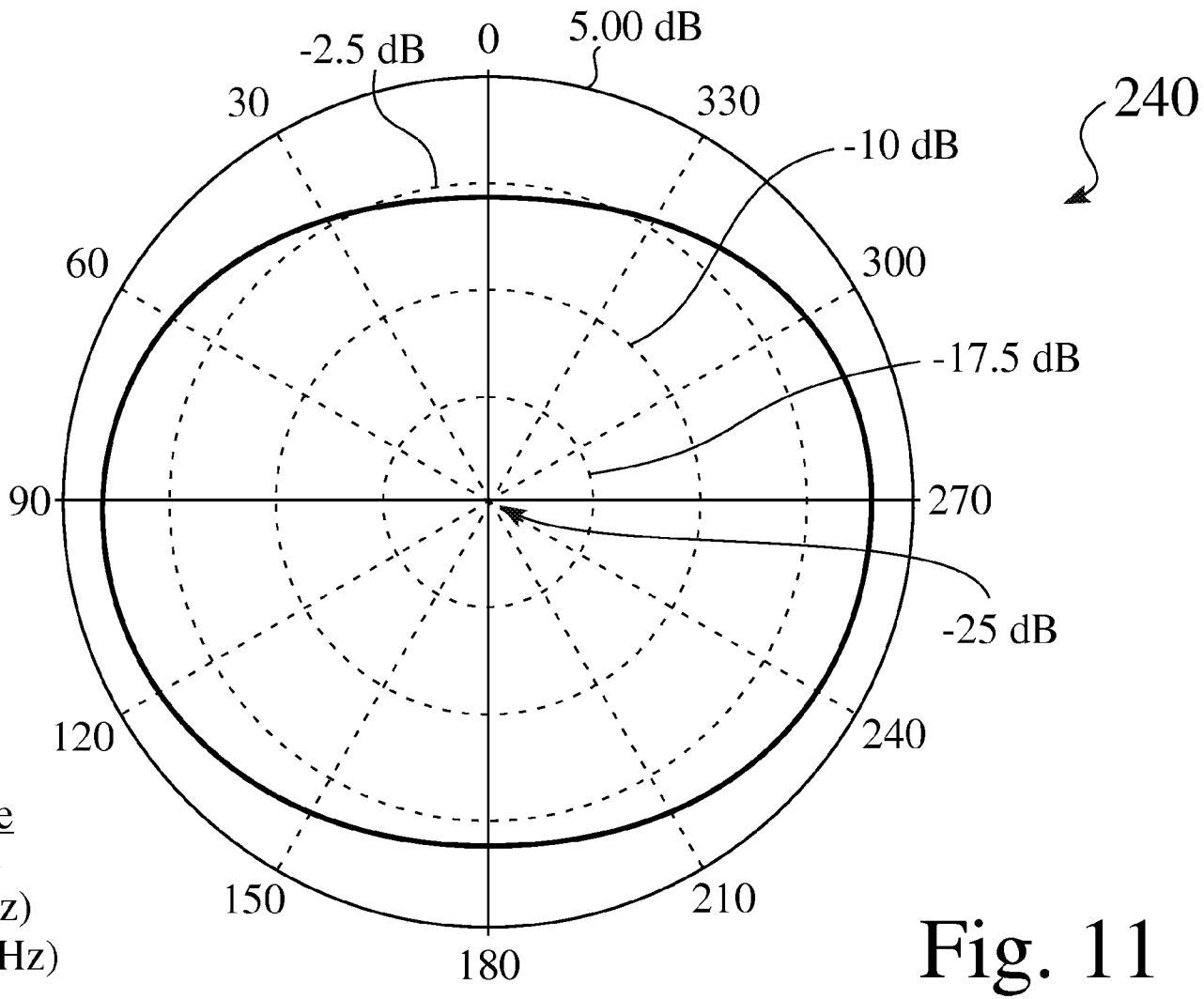
FIG. 11 is a graph showing simulated XY Plane passive measurement performance for an exemplary enhanced on board PCB antenna operating at 850 MHz.
Figure 12:
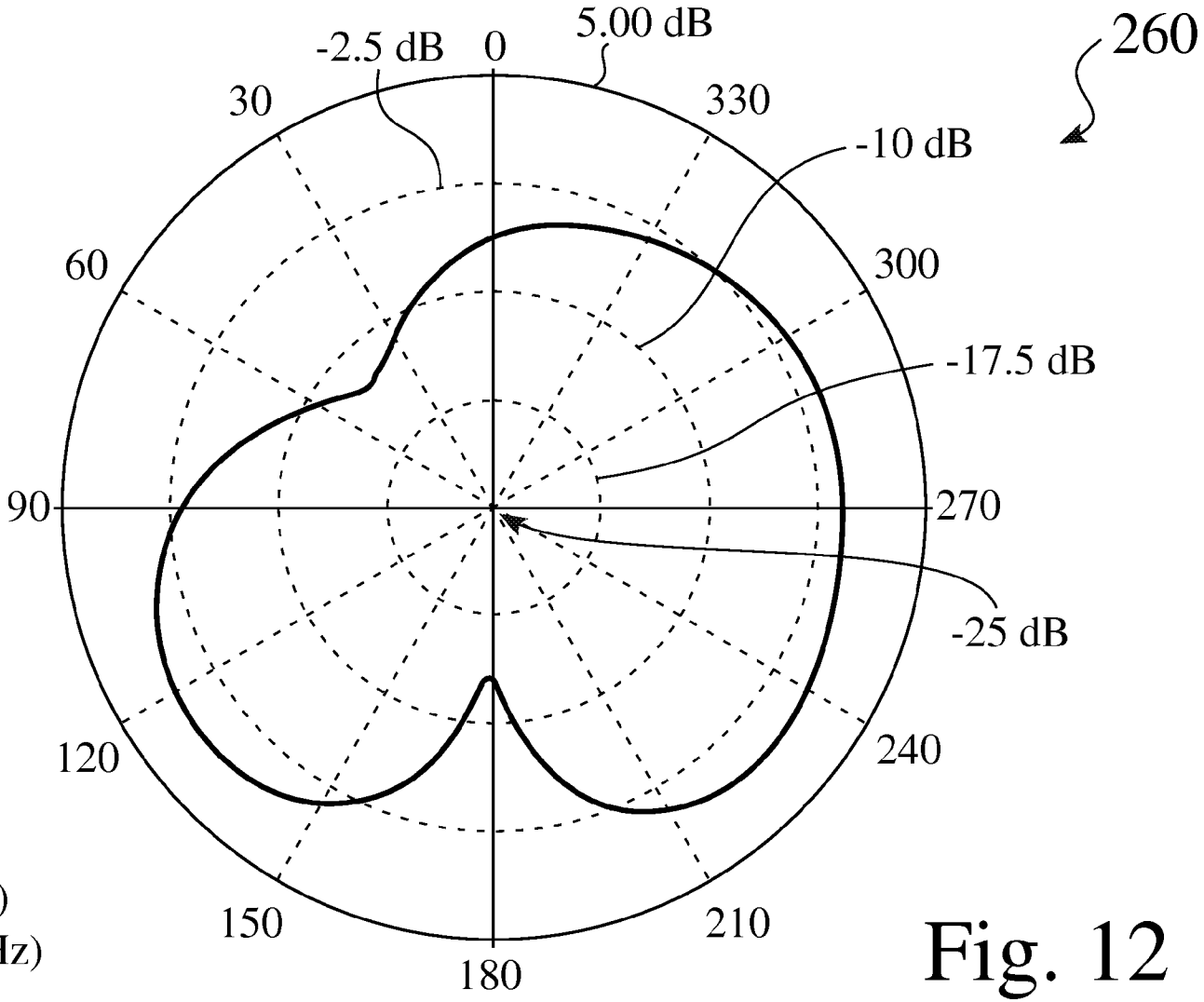
FIG. 12 is a graph showing simulated XZ Plane passive measurement performance for an exemplary enhanced on board PCB antenna operating at 850 MHz.
Figure 13:
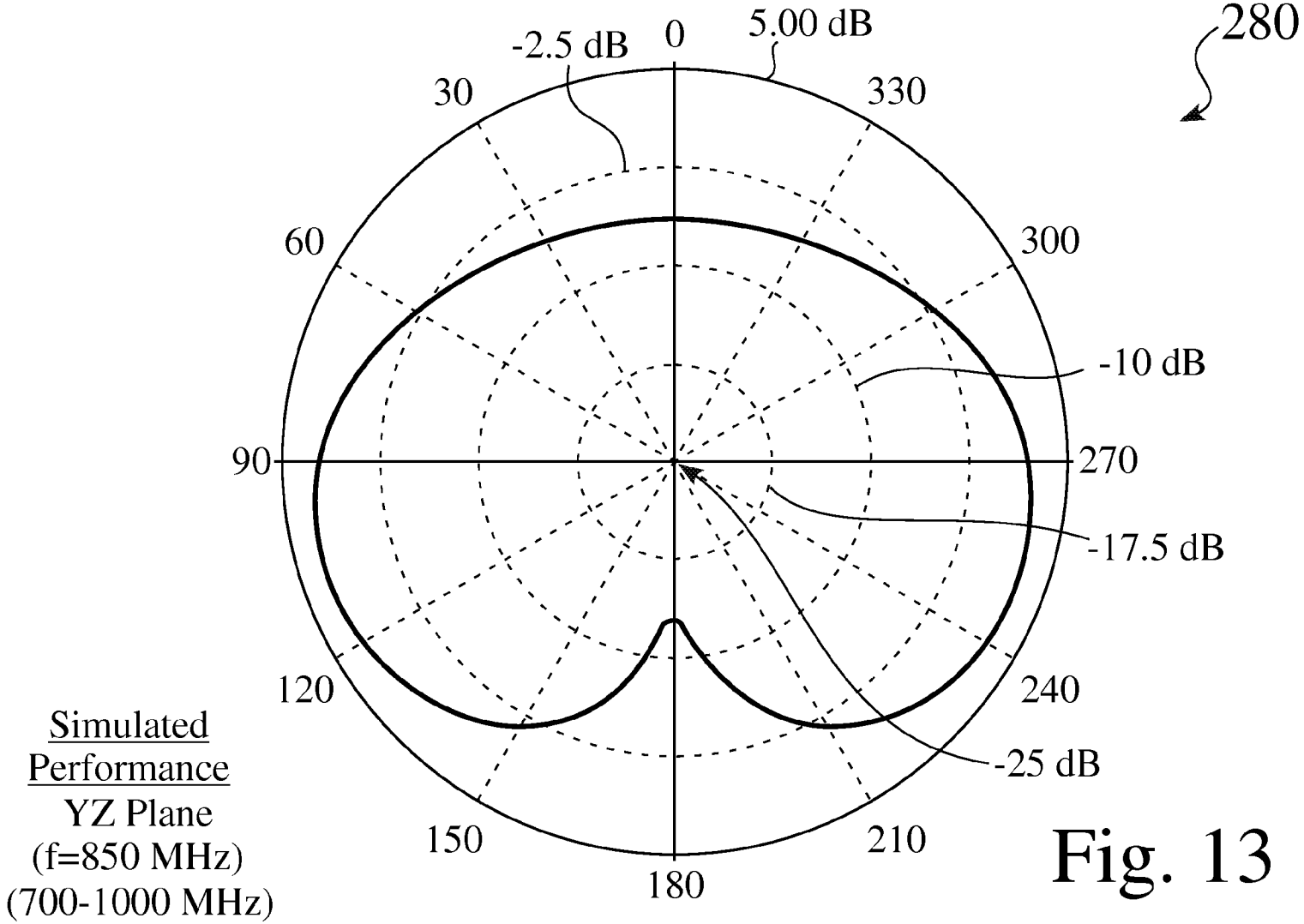
FIG. 13 is a graph showing simulated YZ Plane passive measurement performance for an exemplary enhanced on board PCB antenna operating at 850 MHz.

FIG. 11 is a graph 240 showing simulated XY Plane passive measurement performance for an exemplary enhanced on board PCB antenna 12 operating at 850 MHz. FIG. 12 is a graph 260 showing simulated XZ Plane passive measurement performance for an exemplary enhanced on board PCB antenna 12 operating at 850 MHz. FIG. 13 is a graph 280 showing simulated YZ Plane passive measurement performance for an exemplary enhanced on board PCB antenna 12 operating at 850 MHz.

Enhanced Antenna Performance at 1700 to 2200 MHz.

FIGS. 14-21 provide a series of graphs showing simulation data and measurement data for 1,700 MHz to 2,200 MHz band operation for an exemplary enhanced antenna 12, such as seen in FIG. 1. In particular, efficiency 142 and peak gain 162 are shown for the enhanced antenna 12, along with simulated and measured gain data with respect to XY plane (azimuth data), as well as XZ plane and YZ plane elevation data. As can be seen, actual measured values compare favorably with simulated values, thus confirming the merit of the antenna herein disclosed.

Figure 14:
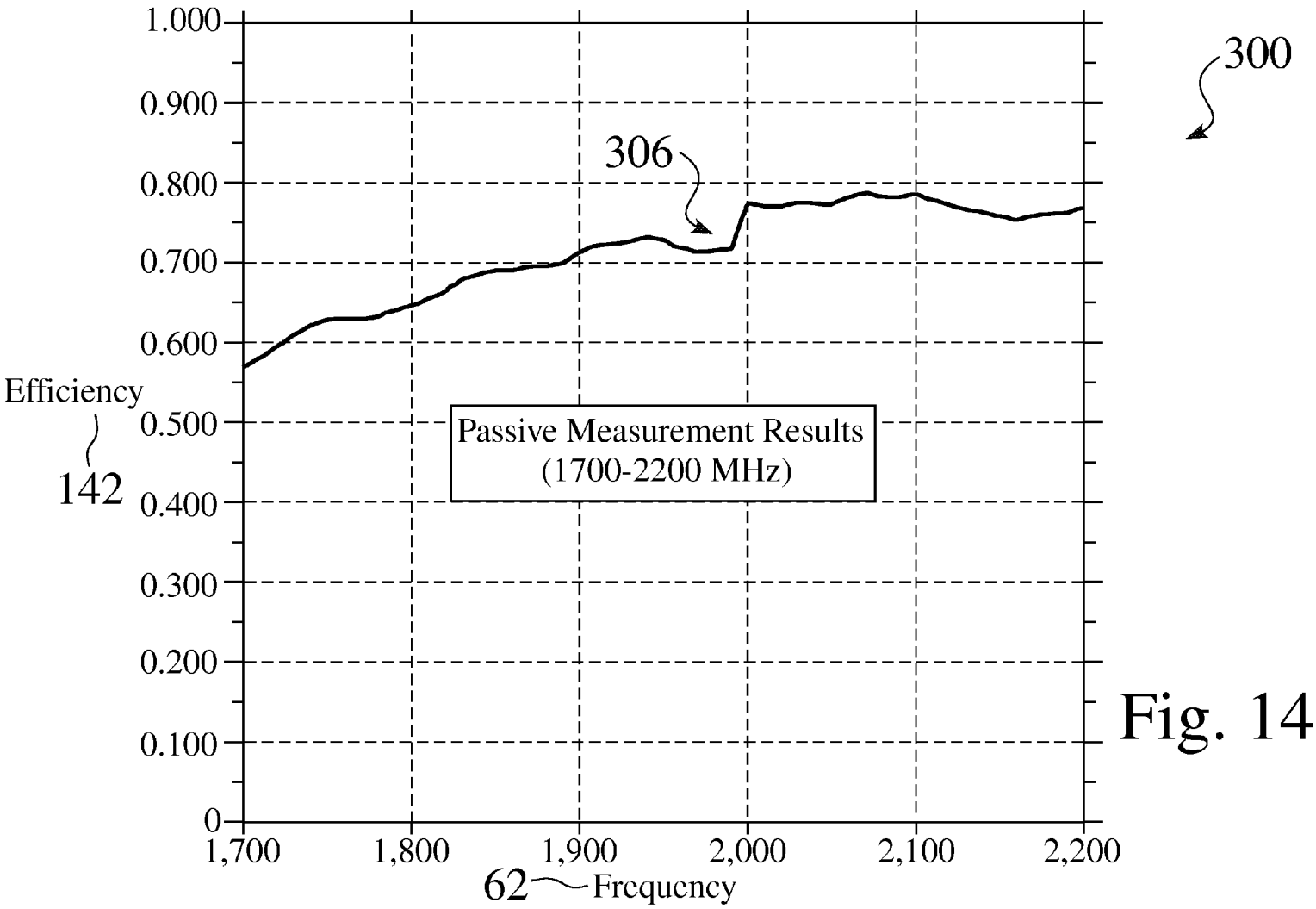
FIG. 14 is a graph showing passive measurement results of efficiency as a function of frequency for an exemplary enhanced on board PCB antenna operating at 1,700 MHz to 2,200 MHz.
Figure 15:
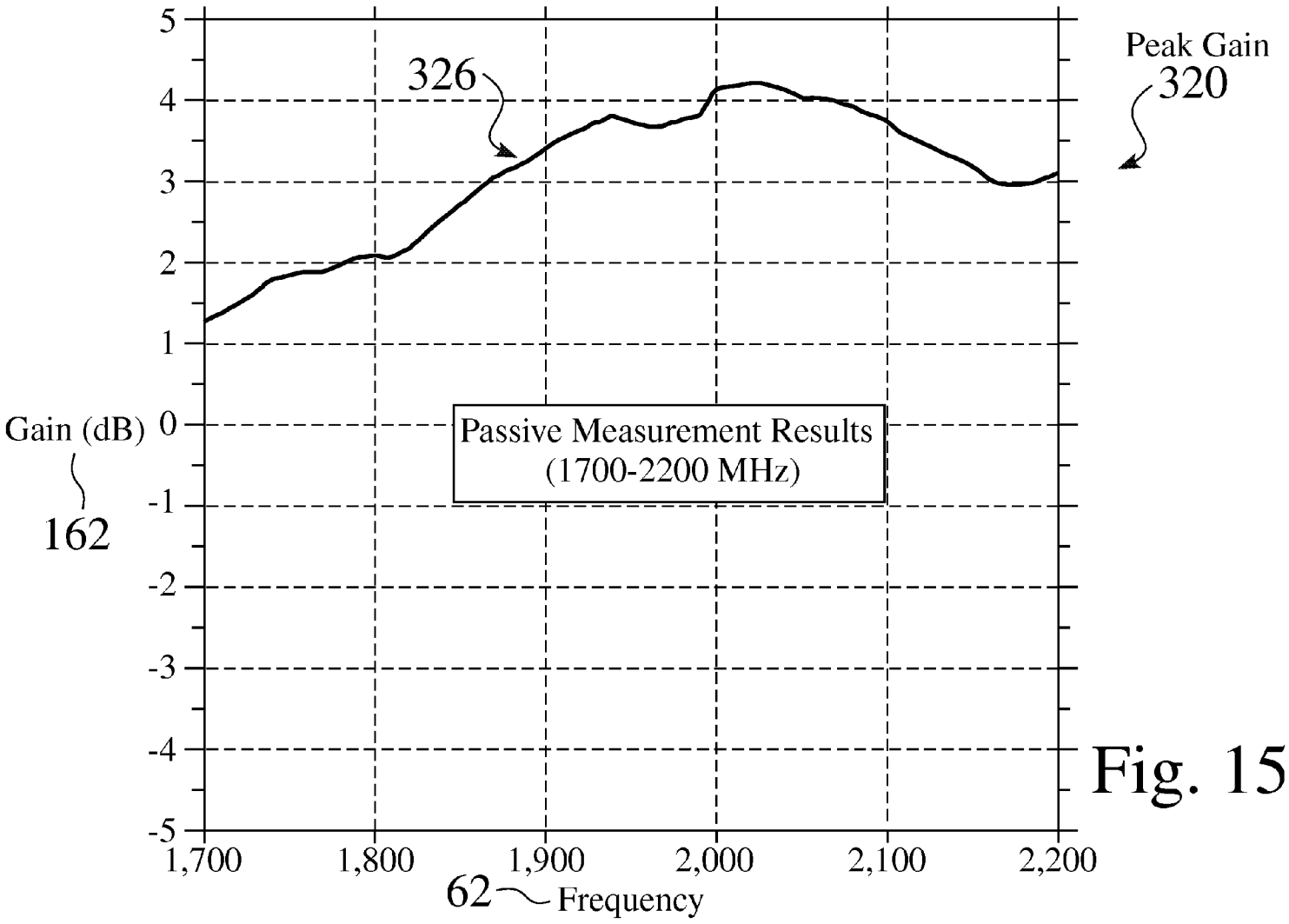
FIG. 15 is a graph showing passive measurement results of peak gain as a function of frequency for an exemplary enhanced on board PCB antenna operating at 1,700 MHz to 2,200 MHz.

FIG. 14 is a graph 300 showing passive measurement results 306 of efficiency 142 as a function of frequency 62 for an exemplary enhanced on board PCB antenna 12 operating at 1,700 MHz to 2,200 MHz. FIG. 15 is a graph 320 showing passive measurement results 326 of peak gain 162 as a function of frequency 62 for an exemplary enhanced on board PCB antenna 12 operating at 1,700 MHz to 2,200 MHz.

Figure 16:
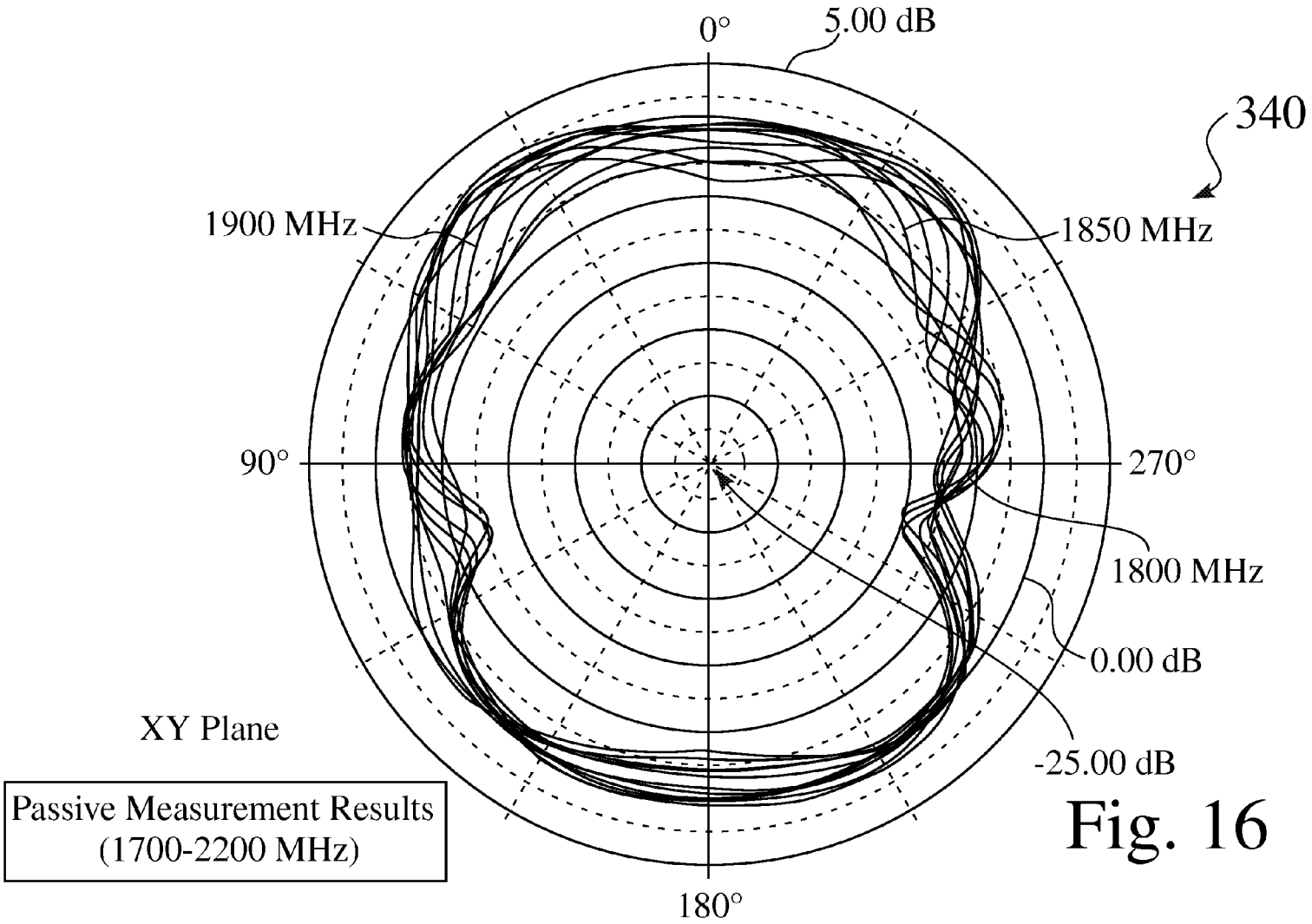
FIG. 16 is a graph showing XY Plane passive measurement performance for an exemplary enhanced on board PCB antenna operating at 1,700 MHz to 2,200 MHz.
Figure 17:
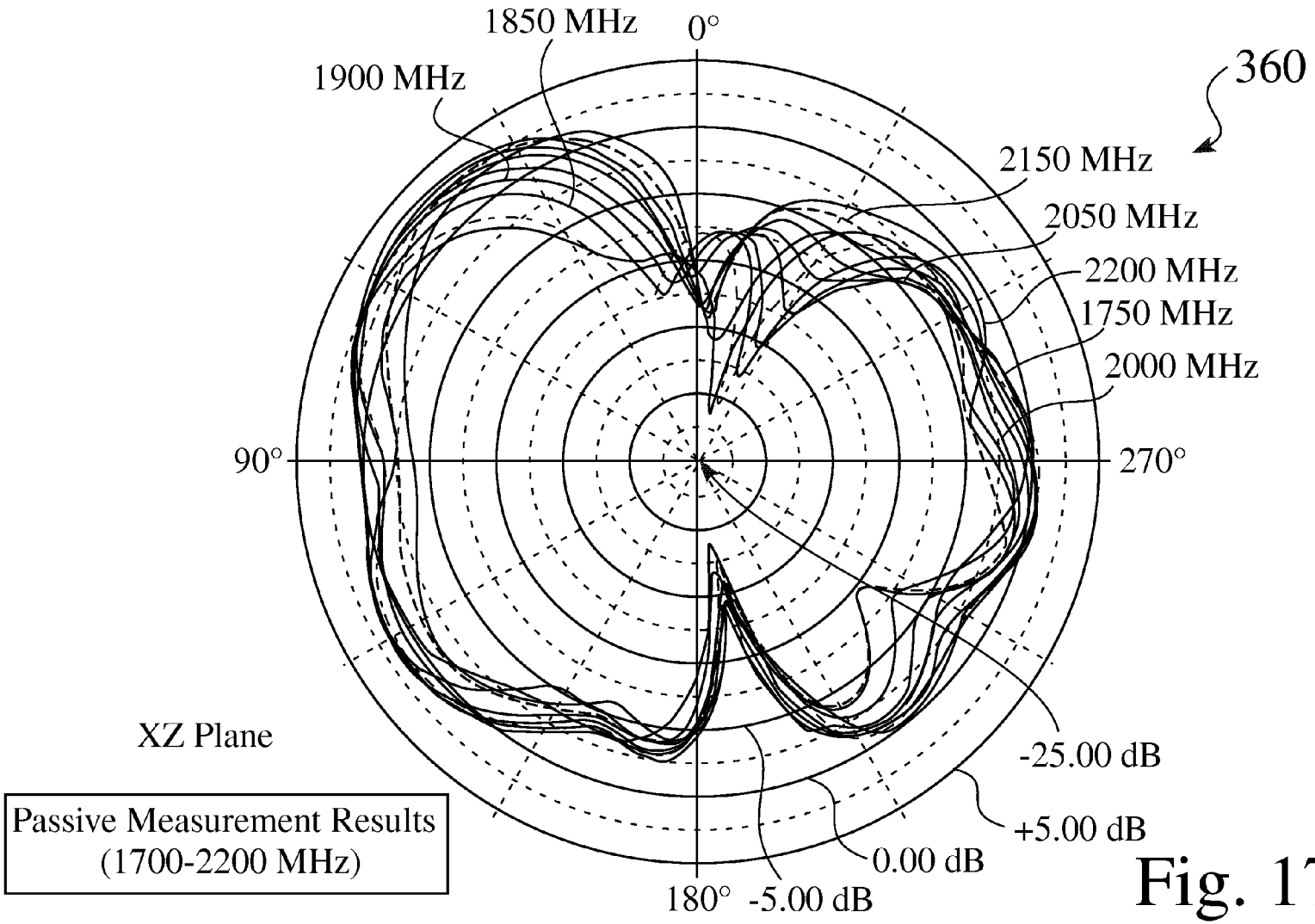
FIG. 17 is a graph showing XZ Plane passive measurement performance for an exemplary enhanced on board PCB antenna operating at 1,700 MHz to 2,200 MHz.
Figure 18:
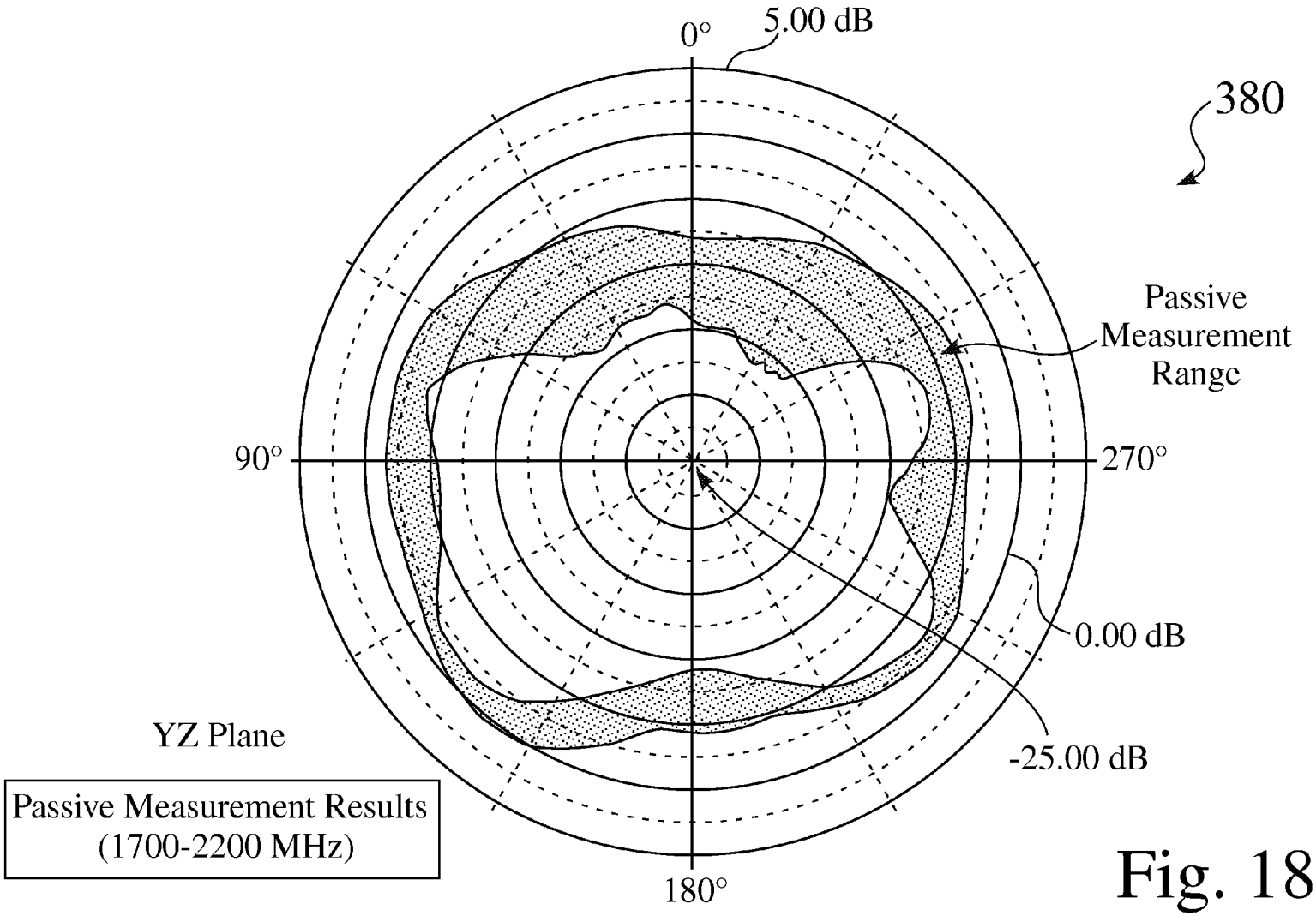
FIG. 18 is a graph showing YZ Plane passive measurement performance for an exemplary enhanced on board PCB antenna operating at 1,700 MHz to 2,200 MHz.

FIG. 16 is a graph 340 showing XY Plane passive measurement performance for an exemplary enhanced on board PCB antenna 12 operating at 1,700 MHz to 2,200 MHz. FIG. 17 is a graph 360 showing XZ Plane passive measurement performance for an exemplary enhanced on board PCB antenna 12 operating at 1,700 MHz to 2,200 MHz. FIG. 18 is a graph 380 showing YZ Plane passive measurement performance for an exemplary enhanced on board PCB antenna 12 operating at 1,700 MHz to 2,200 MHz.

Figure 19:
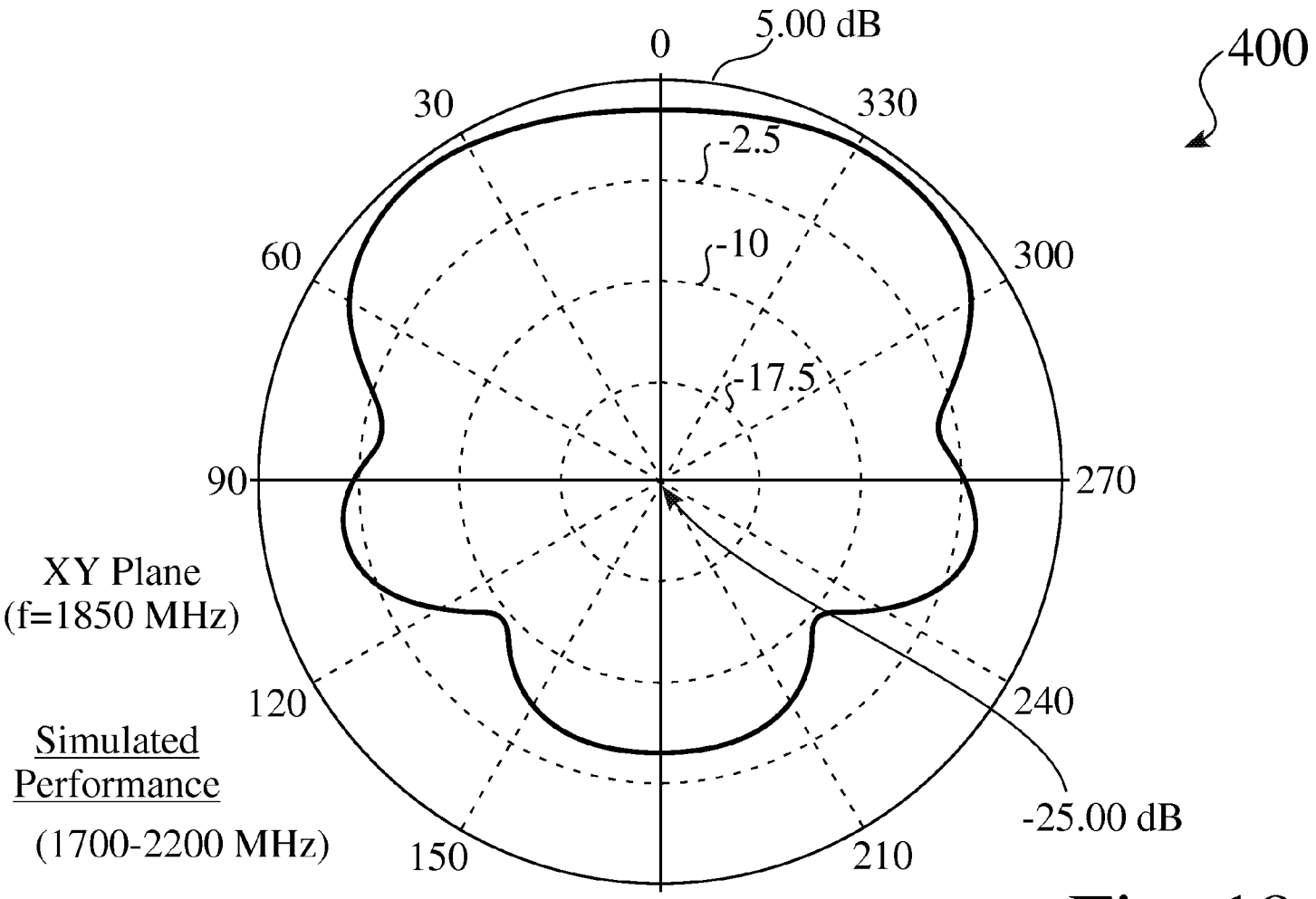
FIG. 19 is a graph showing simulated XY Plane passive measurement performance for an exemplary enhanced on board PCB antenna operating at 1,850 MHz.
Figure 20:
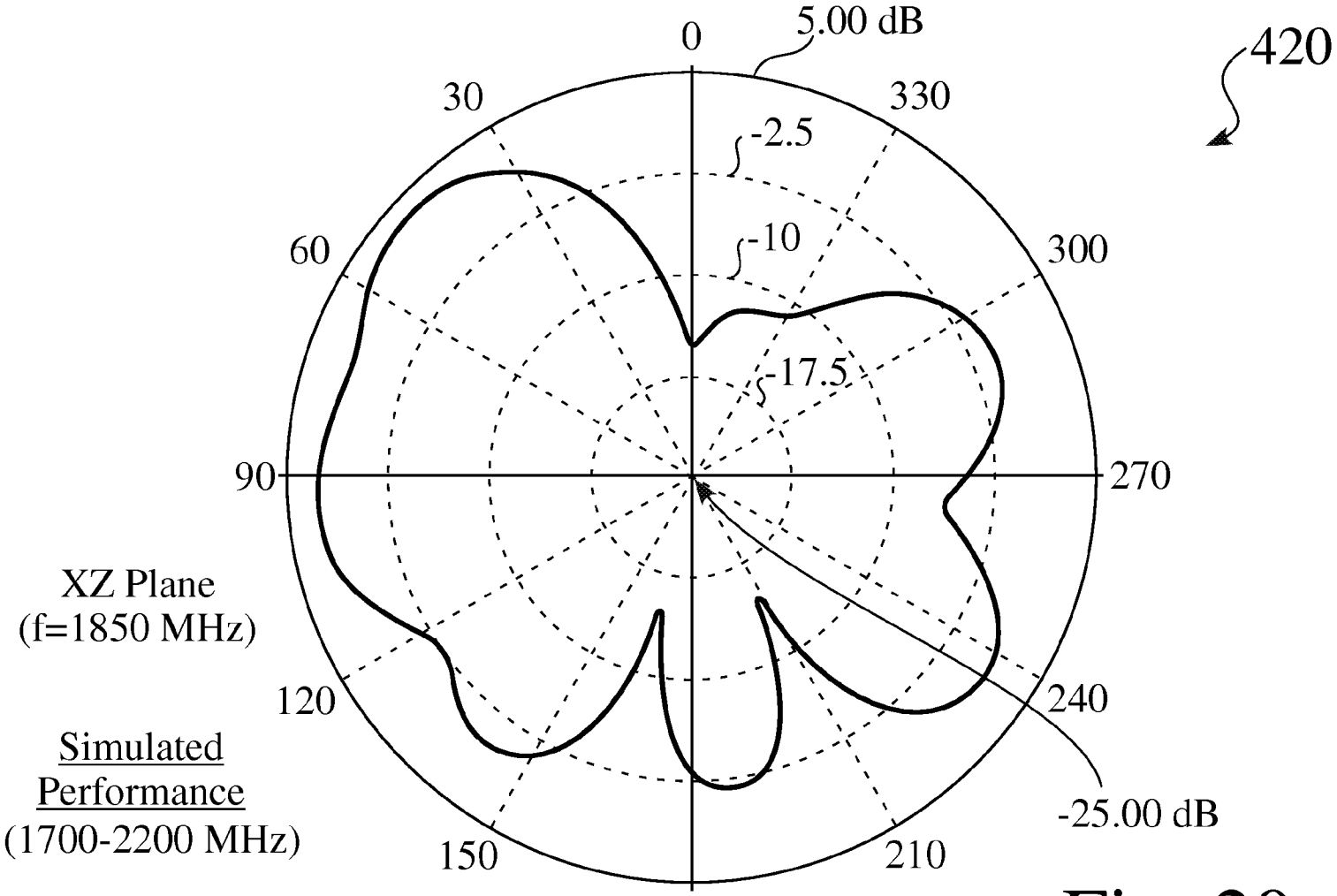
FIG. 20 is a graph showing simulated XZ Plane passive measurement performance for an exemplary enhanced on board PCB antenna operating at 1,850 MHz.
Figure 21:
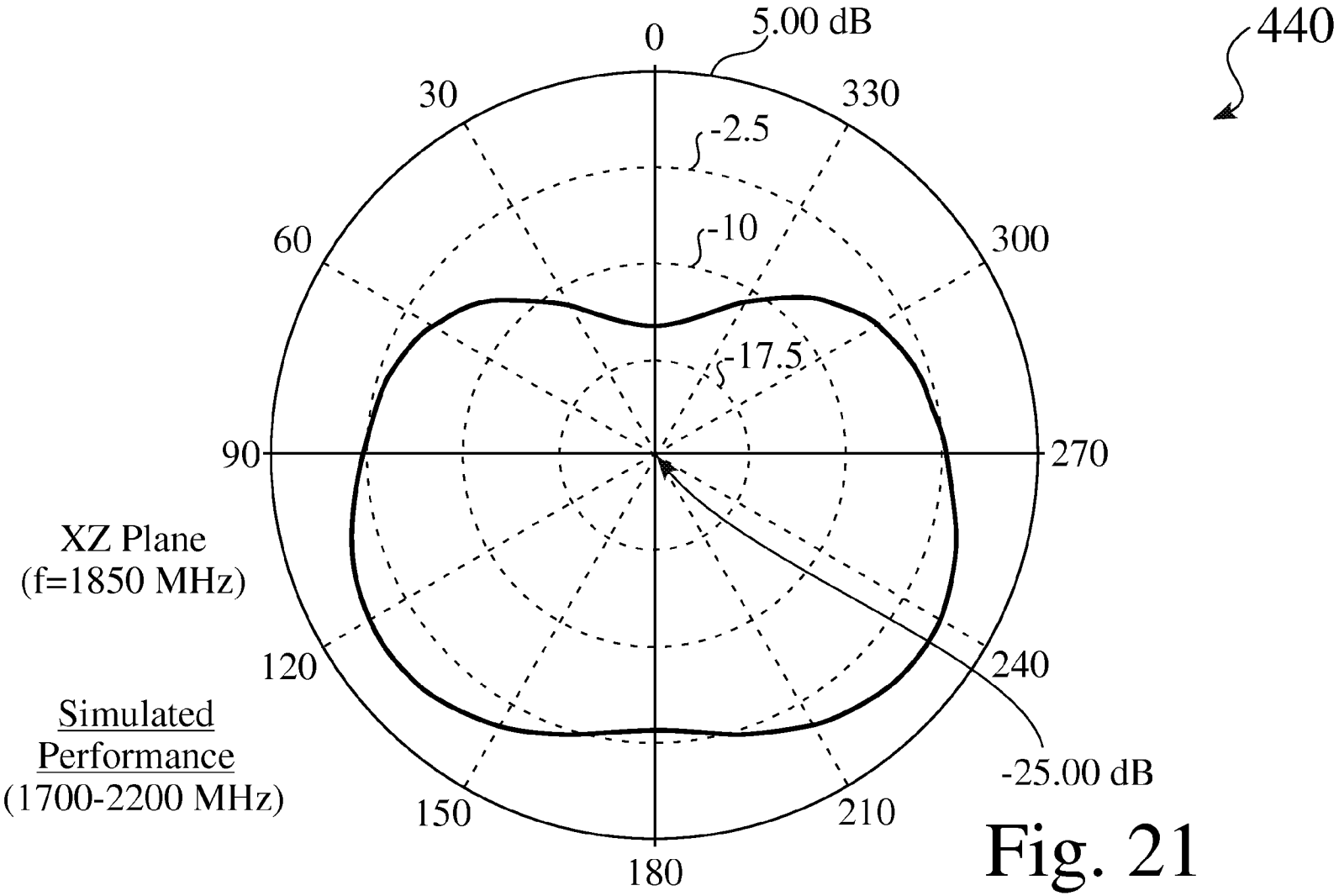
FIG. 21 is a graph showing simulated YZ Plane passive measurement performance for an exemplary enhanced on board PCB antenna operating at 1,850 MHz.

FIG. 19 is a graph 400 showing simulated XY Plane passive measurement performance for an exemplary enhanced on board PCB antenna 12 operating at 1,850 MHz. FIG. 20 is a graph 420 showing simulated XZ Plane passive measurement performance for an exemplary enhanced on board PCB antenna 12 operating at 1,850 MHz. FIG. 21 is a graph 440 showing simulated YZ Plane passive measurement performance for an exemplary enhanced on board PCB antenna 12 operating at 1,850 MHz.

Antenna Performance at 2500 to 2700 MHz.

FIGS. 22-29 provide a series of graphs showing simulation data and measurement data for 2,500 MHz to 2,700 MHz band operation for the exemplary enhanced antenna 12, such as seen in FIG. 1. In particular, efficiency 142 and peak gain 162 are shown for the enhanced antenna 12, along with simulated and measured gain data with respect to XY plane (azimuth data), as well as XZ plane and YZ plane elevation data. As can be seen, actual measured values compare favorably with simulated values, thus confirming the merit of the enhanced antenna 12 herein disclosed.

Figure 22:
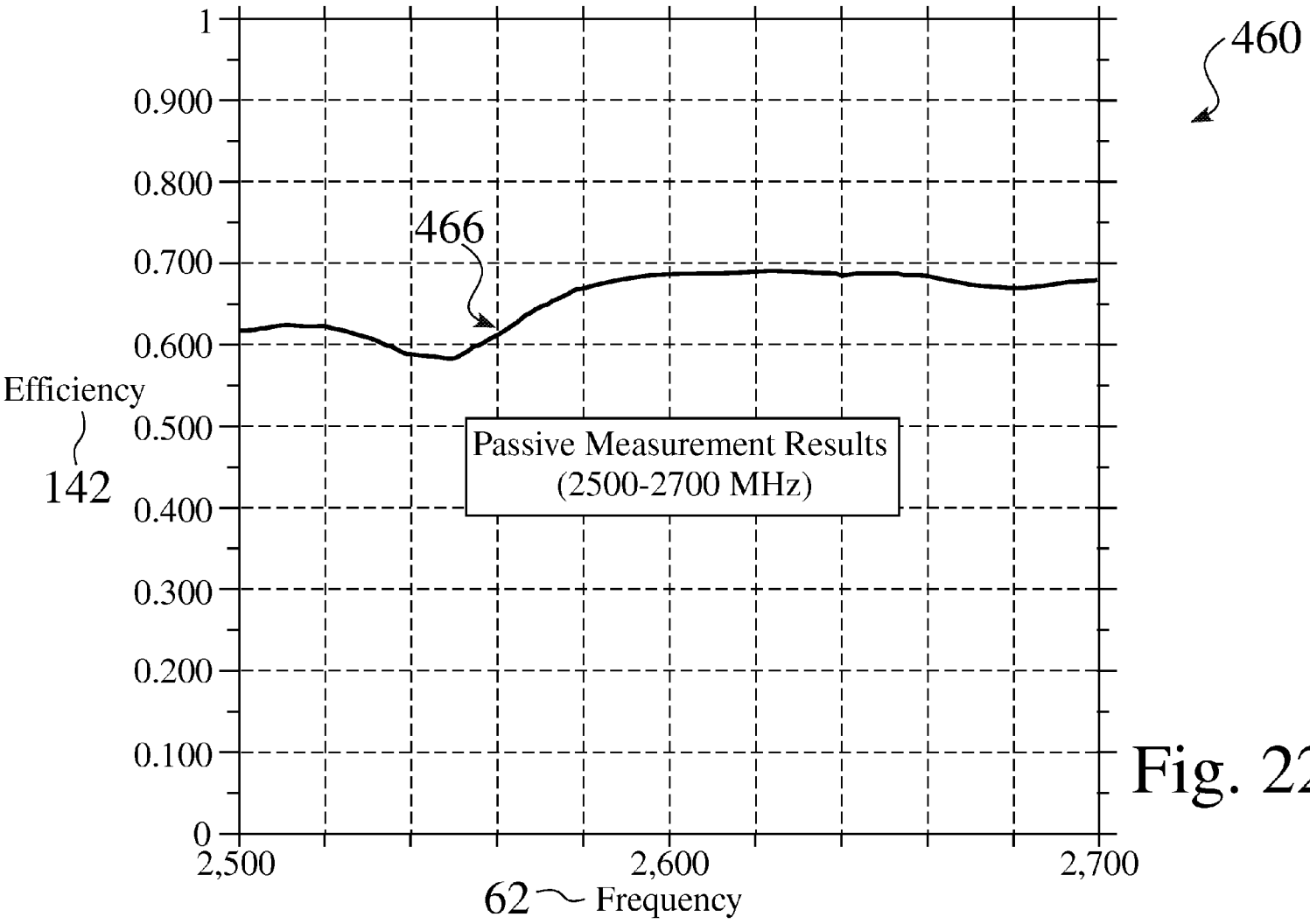
FIG. 22 is a graph showing passive measurement results of efficiency as a function of frequency for an exemplary enhanced on board PCB antenna operating at 2,500 MHz to 2,700 MHz.
Figure 23:
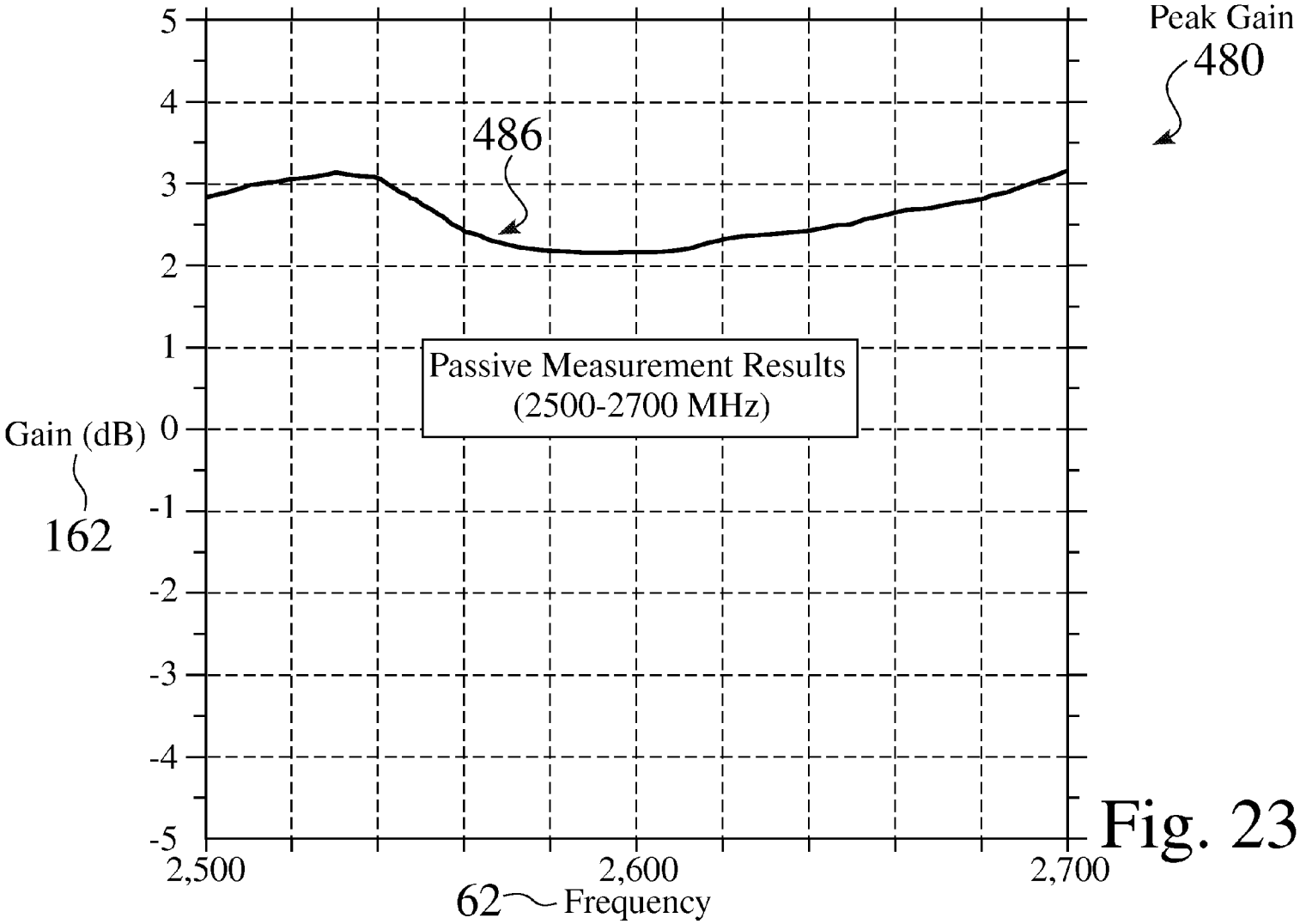
FIG. 23 is a graph showing passive measurement results of peak gain as a function of frequency for an exemplary enhanced on board PCB antenna operating at 2,500 MHz to 2,700 MHz.

FIG. 22 is a graph 460 showing passive measurement results 466 of efficiency 142 as a function of frequency 62 for an exemplary enhanced on board PCB antenna operating at 2,500 MHz to 2,700 MHz. FIG. 23 is a graph 480 showing passive measurement results of peak gain as a function of frequency for an exemplary enhanced on board PCB antenna operating at 2,500 MHz to 2,700 MHz.

Figure 24:
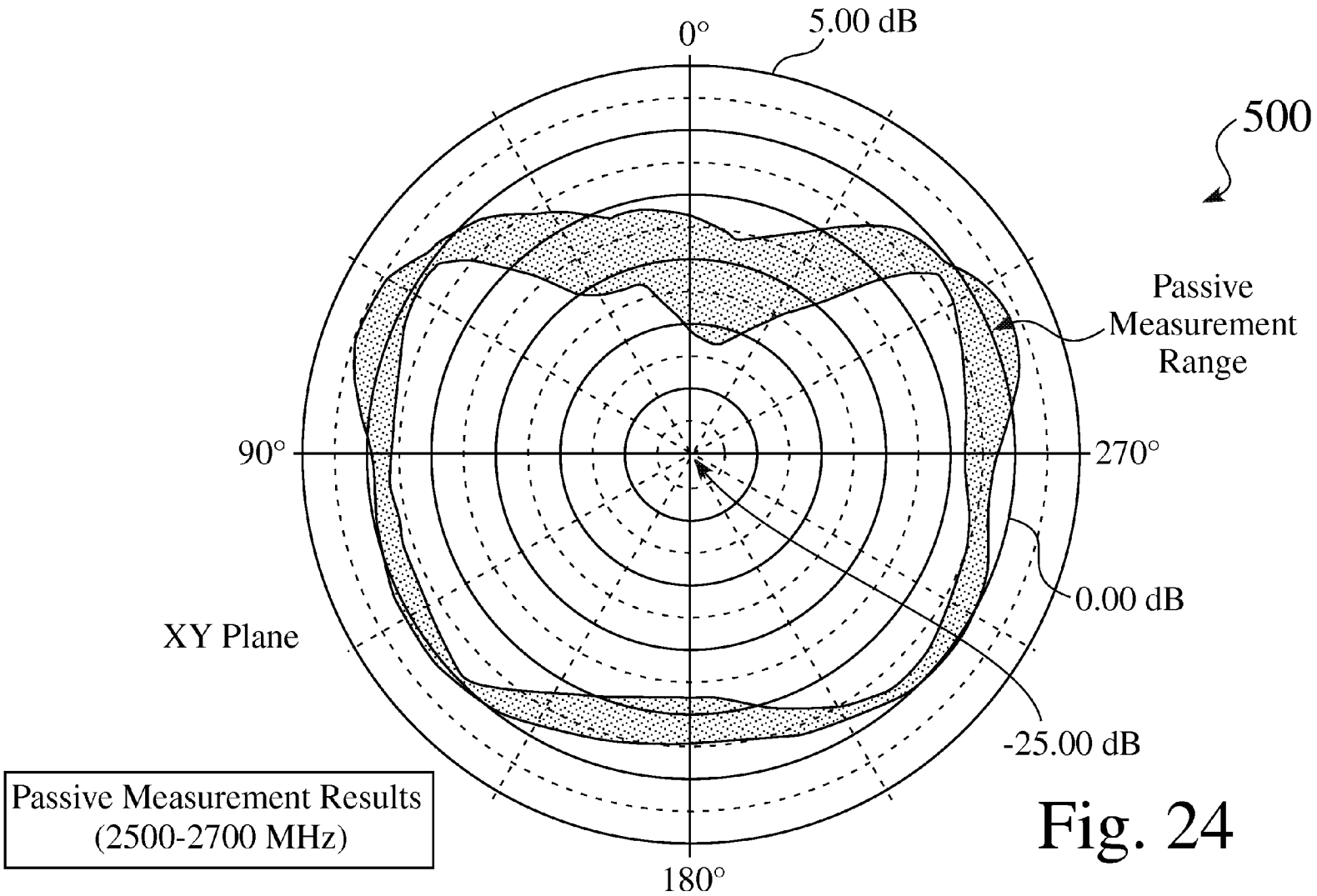
FIG. 24 is a graph showing XY Plane passive measurement performance for an exemplary enhanced on board PCB antenna operating at 2,500 MHz to 2,700 MHz.
Figure 25:
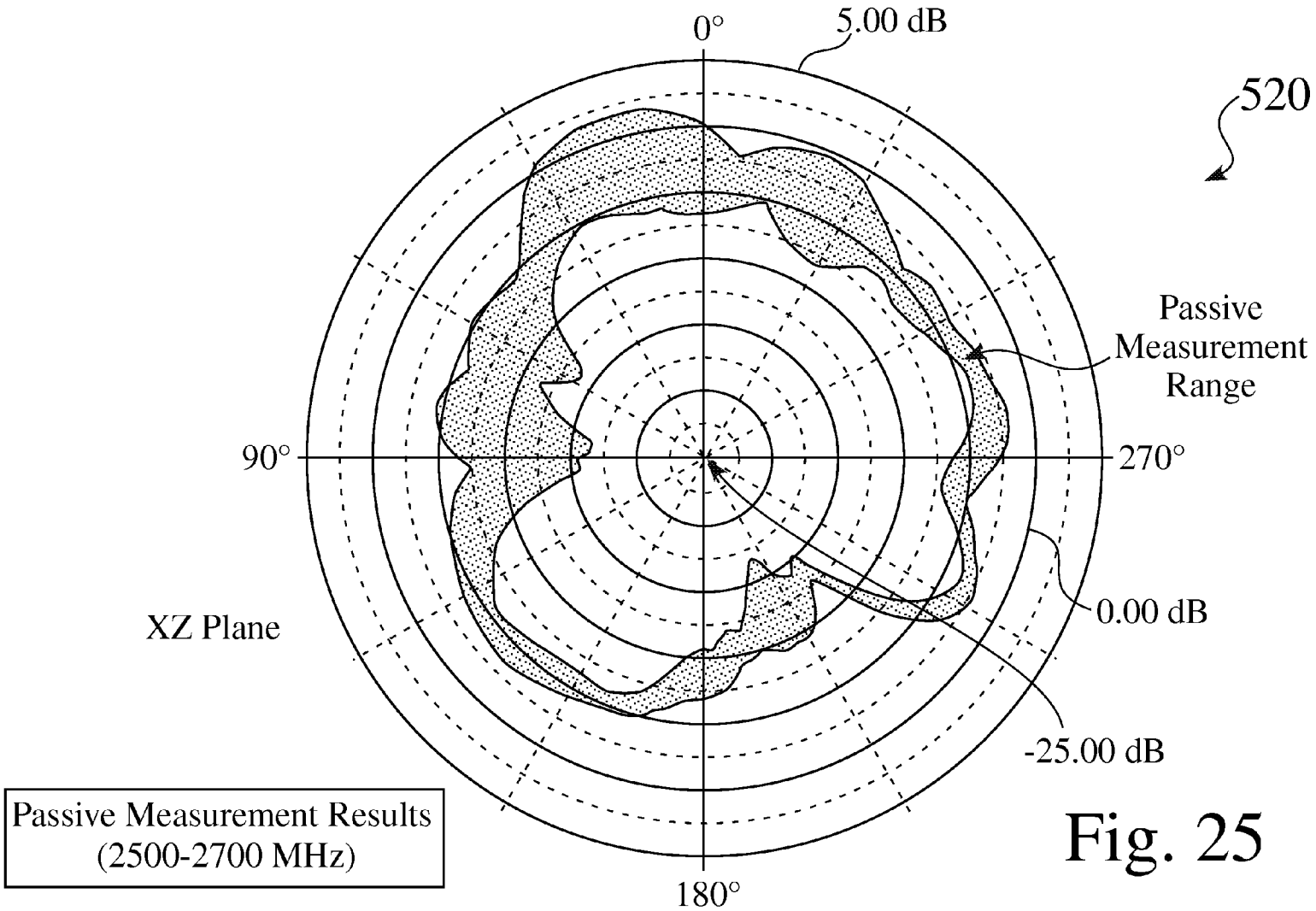
FIG. 25 is a graph showing XZ Plane passive measurement performance for an exemplary enhanced on board PCB antenna operating at 2,500 MHz to 2,700 MHz.
Figure 26:
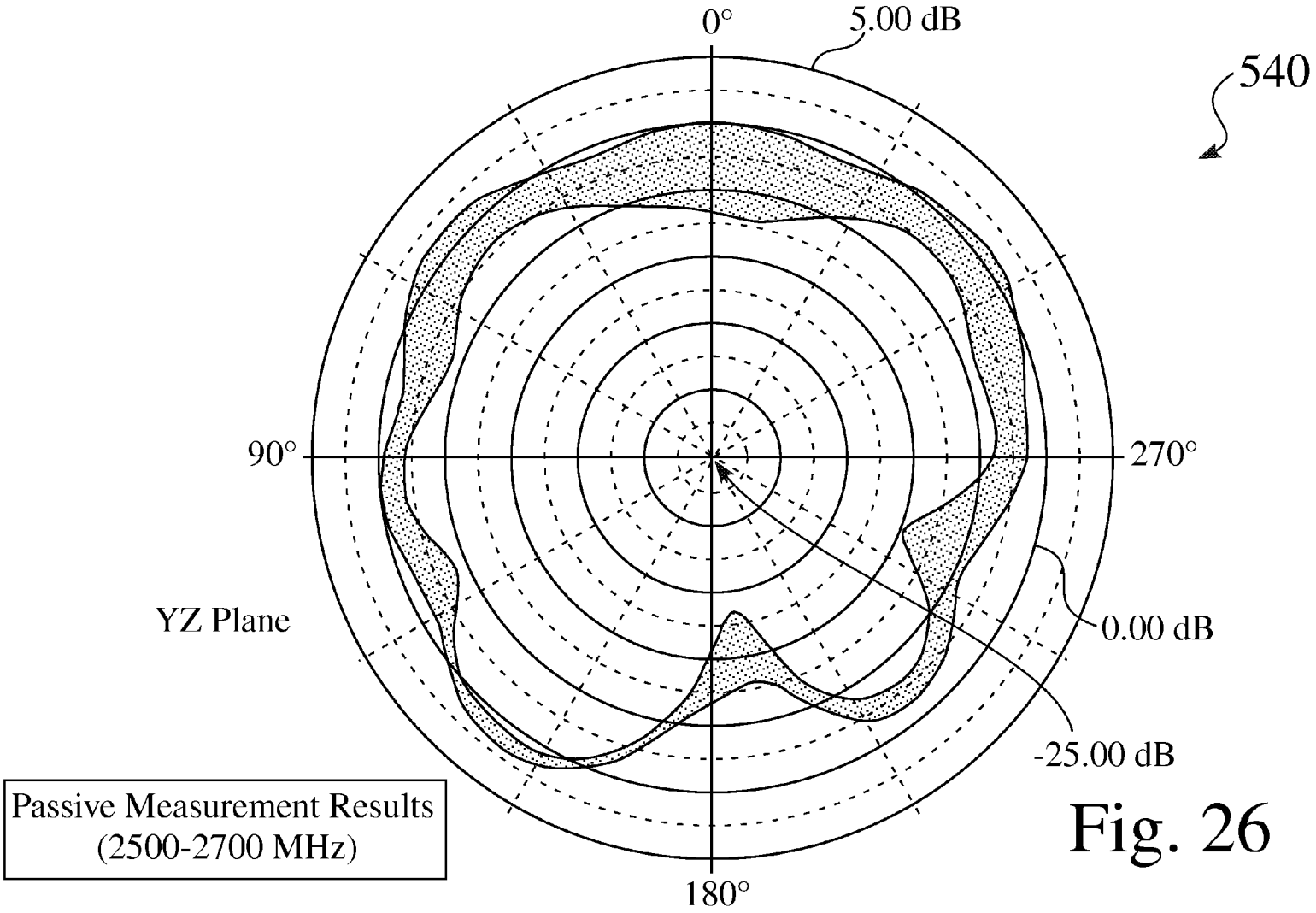
FIG. 26 is a graph showing YZ Plane passive measurement performance for an exemplary enhanced on board PCB antenna operating at 2,500 MHz to 2,700 MHz.

FIG. 24 is a graph 500 showing XY Plane passive measurement performance for an exemplary enhanced on board PCB antenna 12 operating at 2,500 MHz to 2,700 MHz. FIG. 25 is a graph 520 showing XZ Plane passive measurement performance for an exemplary enhanced on board PCB antenna 12 operating at 2,500 MHz to 2,700 MHz. FIG. 26 is a graph 540 showing YZ Plane passive measurement performance for an exemplary enhanced on board PCB antenna 12 operating at 2,500 MHz to 2,700 MHz.

Figure 27:
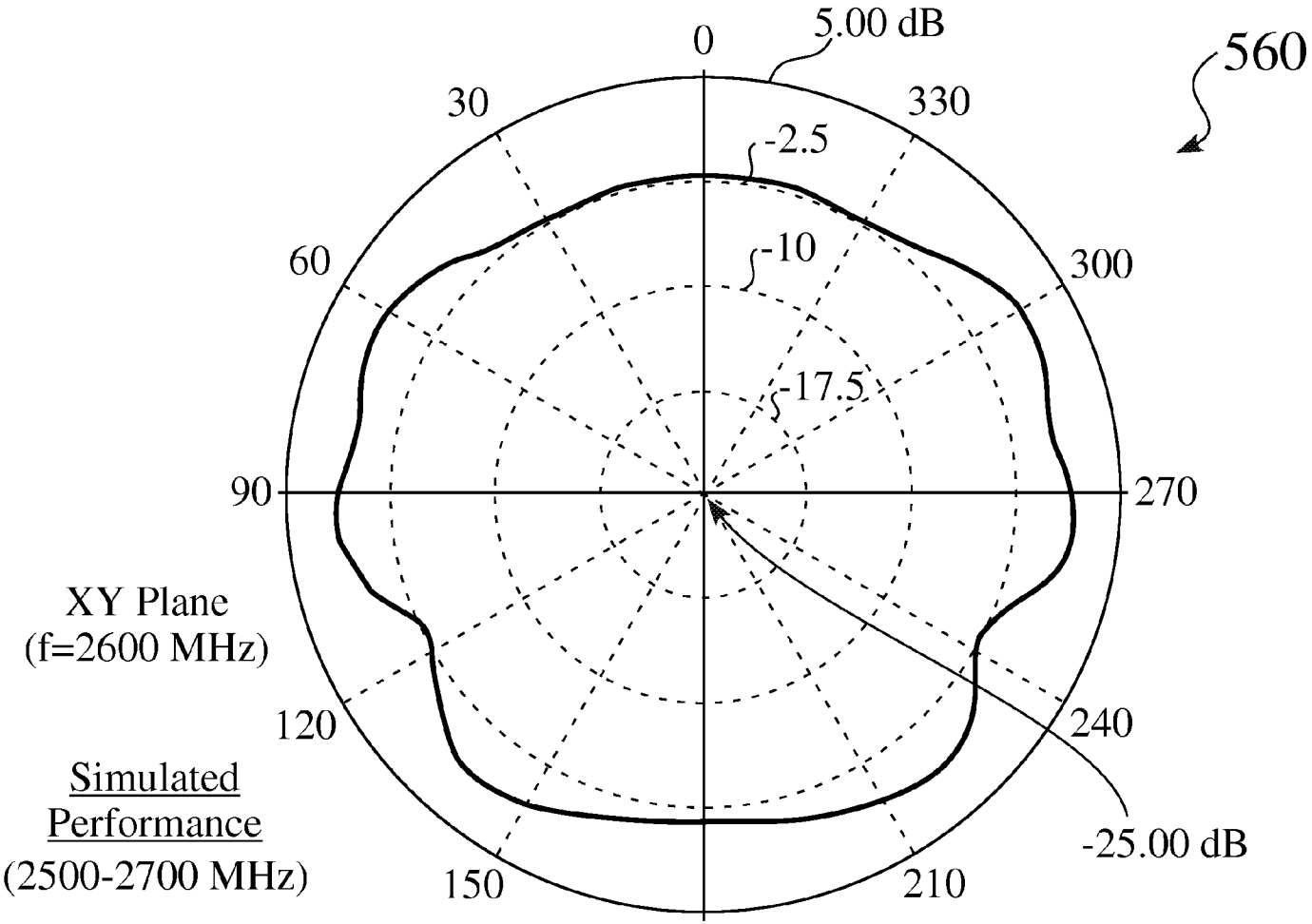
FIG. 27 is a graph showing simulated XY Plane passive measurement performance for an exemplary enhanced on board PCB antenna operating at 2,600 MHz.
Figure 28:
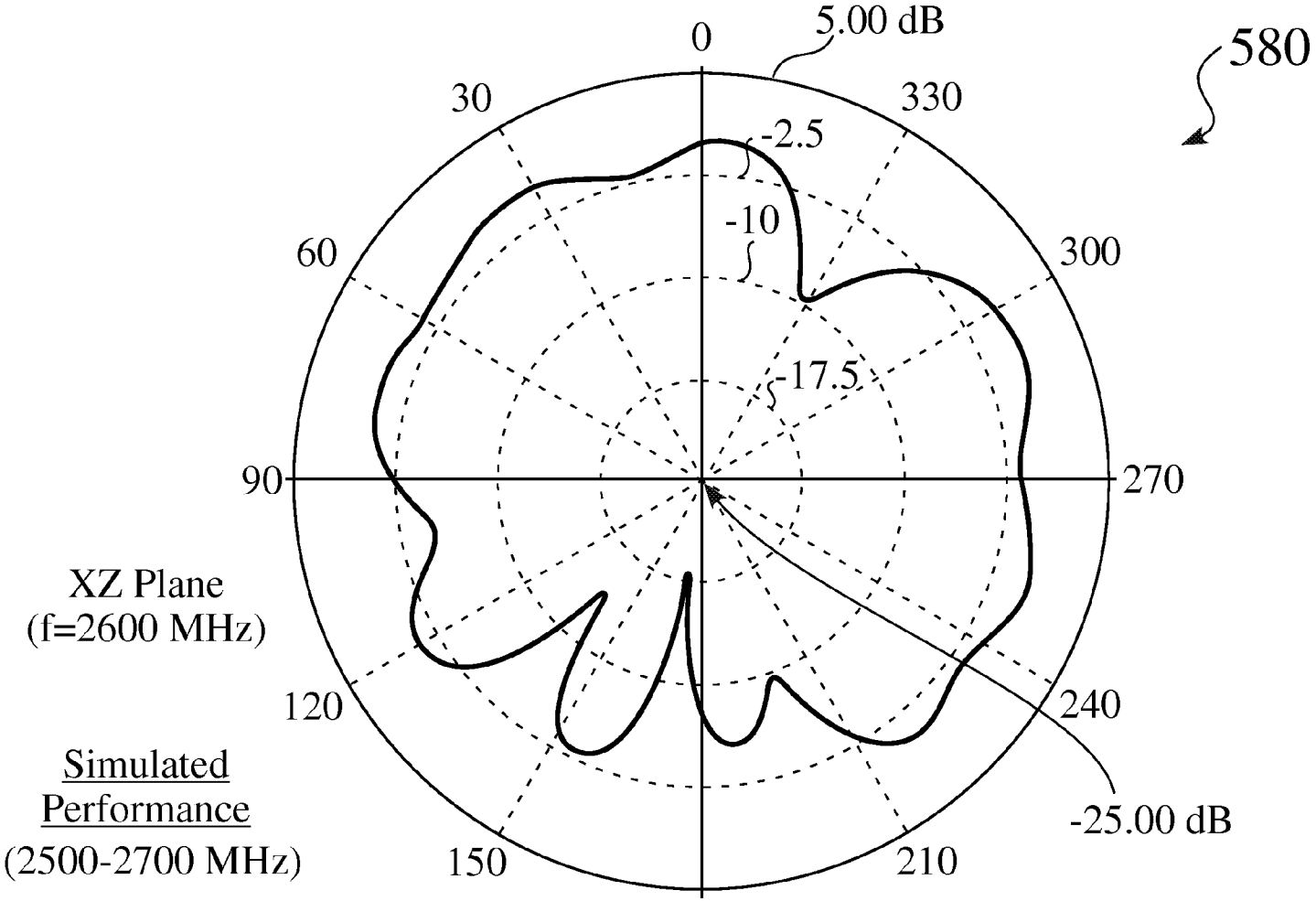
FIG. 28 is a graph showing simulated XZ Plane passive measurement performance for an exemplary enhanced on board PCB antenna operating at 2,600 MHz.
Figure 29:
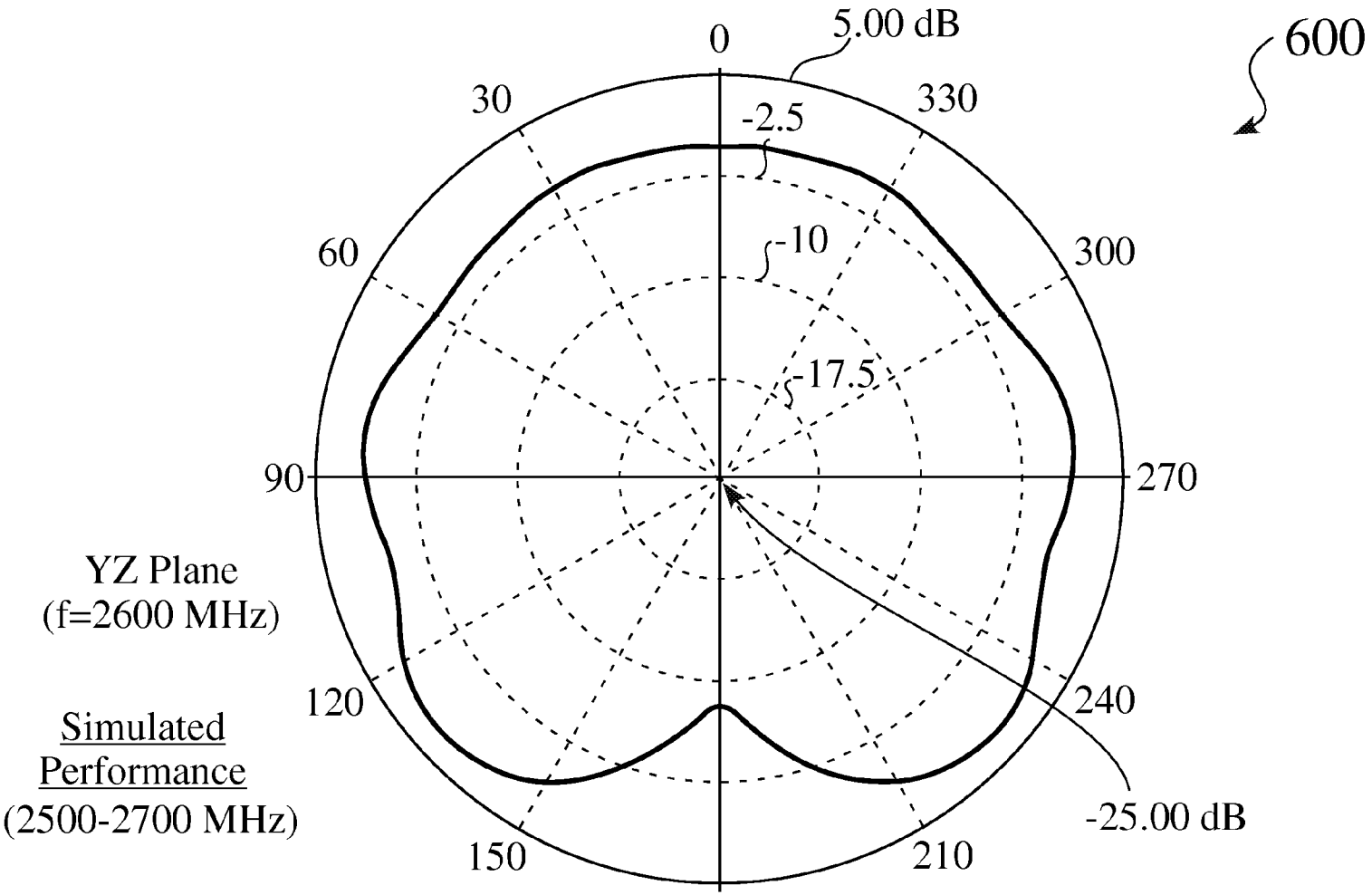
FIG. 29 is a graph showing simulated YZ Plane passive measurement performance for an exemplary enhanced on board PCB antenna operating at 2,600 MHz.

FIG. 27 is a graph 560 showing simulated XY Plane passive measurement performance for an exemplary enhanced on board PCB antenna operating at 2,600 MHz. FIG. 28 is a graph 580 showing simulated XZ Plane passive measurement performance for an exemplary enhanced on board PCB antenna operating at 2,600 MHz. FIG. 29 is a graph 600 showing simulated YZ Plane passive measurement performance for an exemplary enhanced on board PCB antenna operating at 2,600 MHz.

Design Details of Enhanced Antenna.

Figure 30:
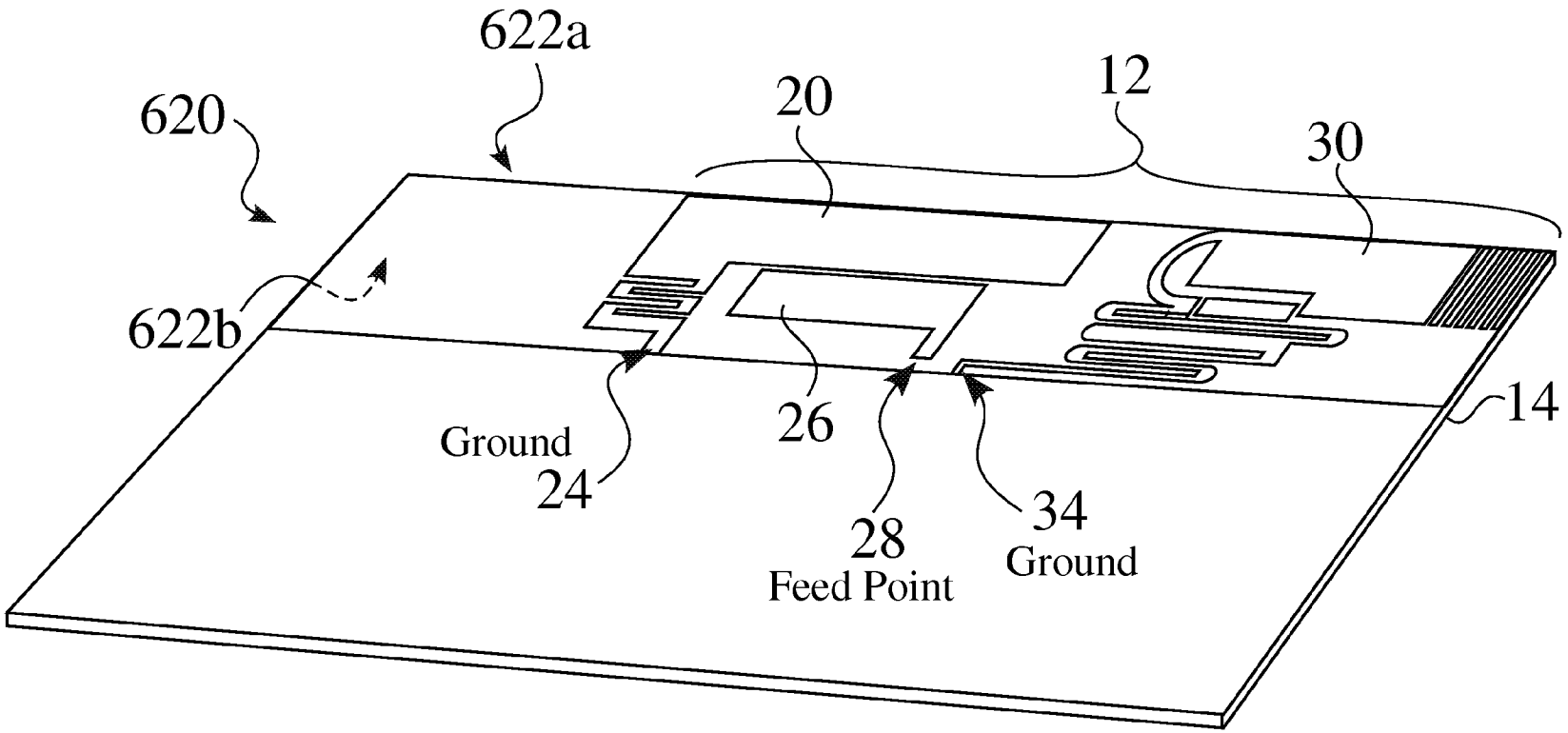
FIG. 30 is a partial perspective view of an exemplary enhanced on board PCB antenna.
Figure 31:
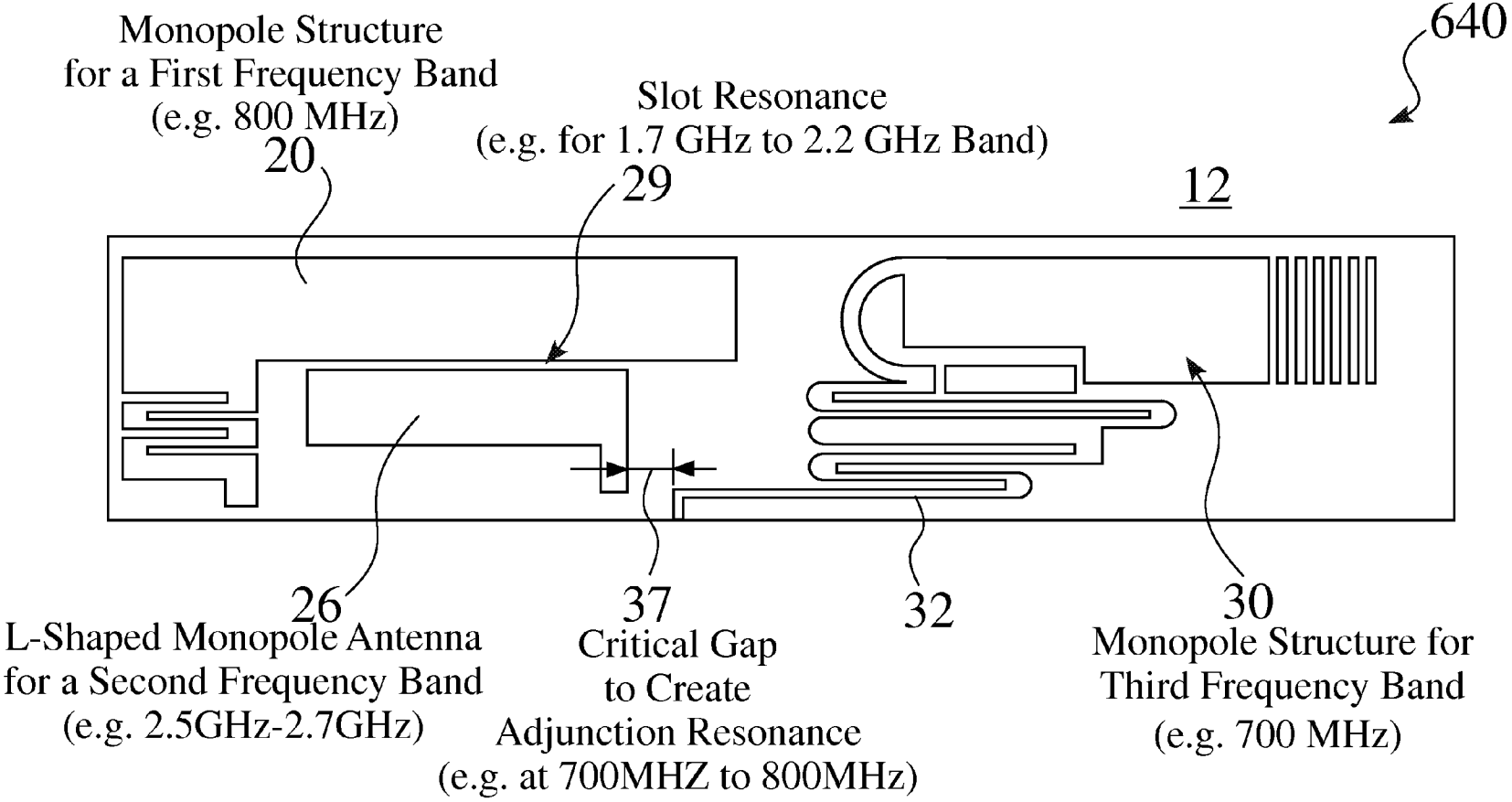
FIG. 31 is a detailed view of an exemplary enhanced on board PCB antenna.
Figure 32:
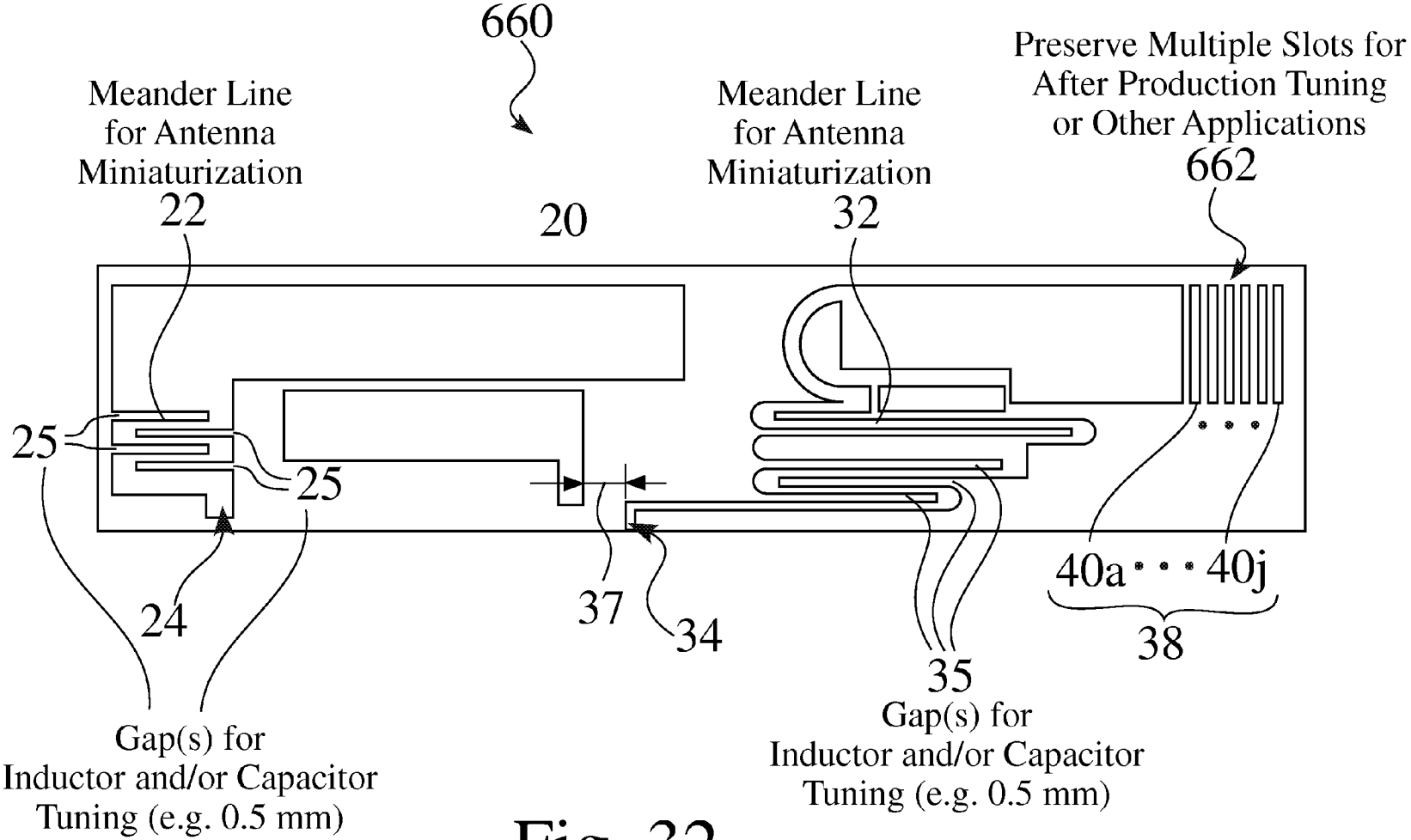
FIG. 32 is a detailed view of an exemplary enhanced on board PCB antenna.

FIG. 30 is a partial perspective view 620 of an exemplary enhanced on board PCB antenna 12, e.g. main PCB for components and circuit trace. FIG. 31 is an alternate detailed view of an exemplary enhanced on board PCB antenna 12. FIG. 32 is an additional alternate view of an exemplary enhanced on board PCB antenna 12.

The enhanced antenna 12 typically comprises radiating elements 20, 26, 30, along with associated meander lines and traces, which may preferably be formed in a single layer PCB 14, which in a current embodiment, has a length 42 of about 73 mm, a width 44 of about 16 mm, and a PCB thickness of about 1.6 mm.

Figure 33:
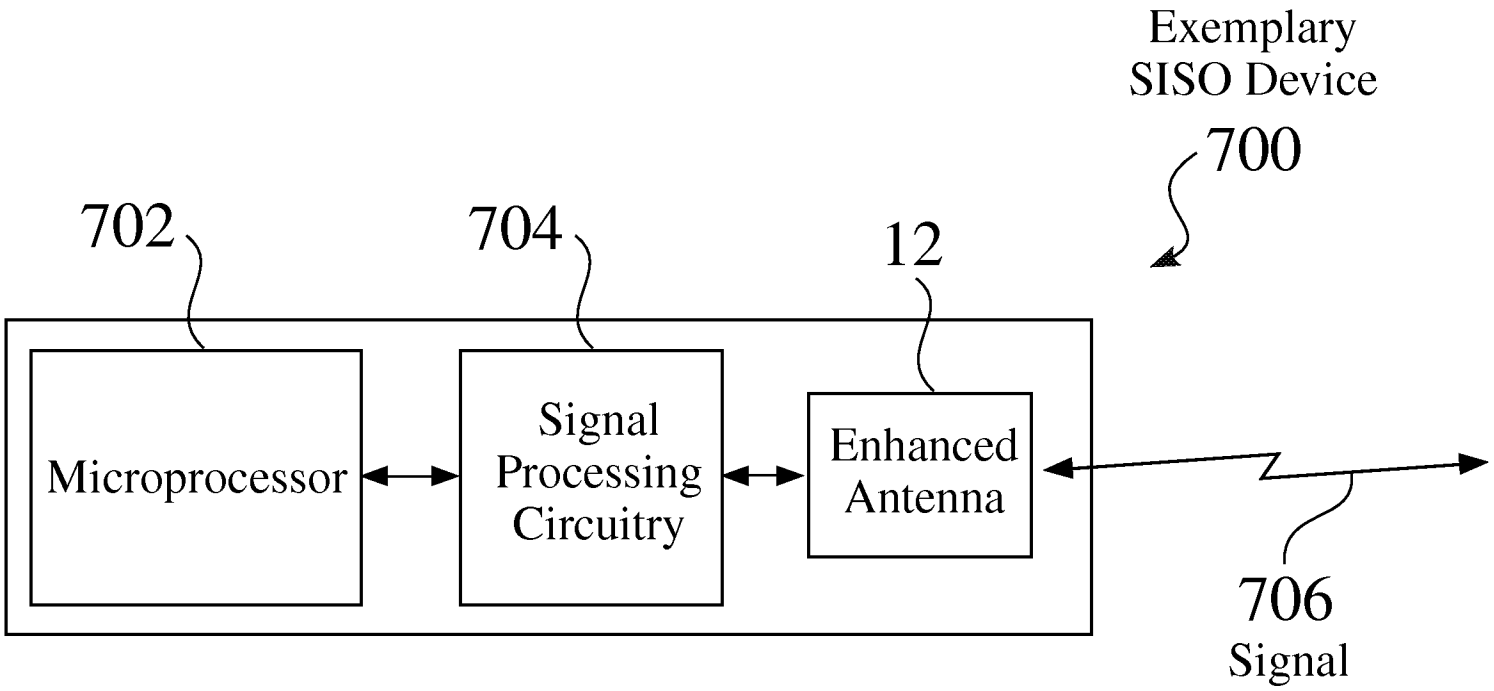
FIG. 33 is a simplified schematic view of an exemplary single-input single-output (SISO) wireless device having an enhanced on board PCB antenna.
Figure 34:
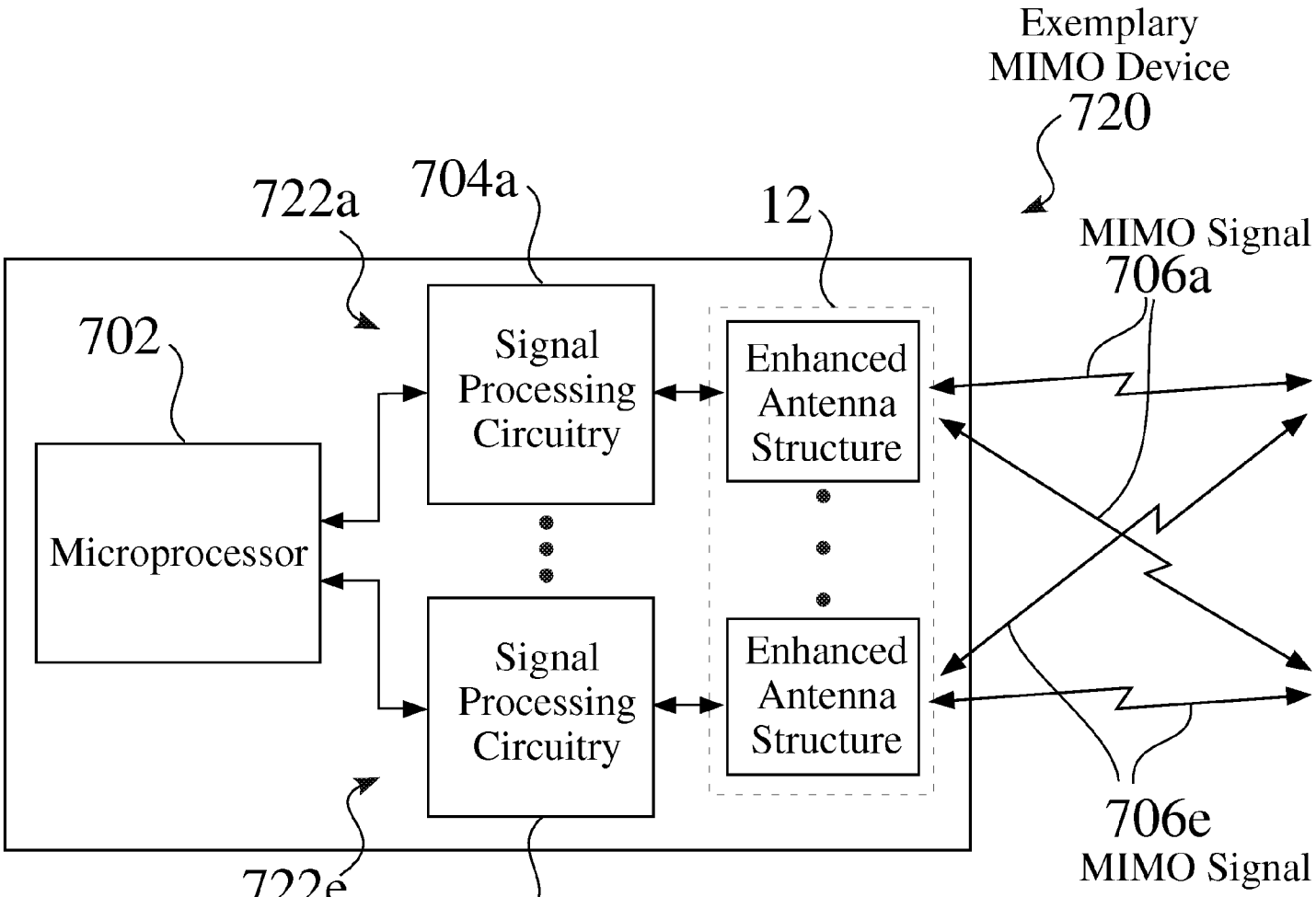
FIG. 34 is a simplified schematic view of an exemplary multiple-input multiple output (MIMO) wireless device having an enhanced on board PCB antenna.

As seen in FIG. 30, the enhanced antenna 12 may readily be fabricated on a PCB 14, which may comprise a dedicated PCB 14 for the enhanced antenna, or may alternately be integrated with one or more structures associated with a device, e.g. such as but not limited to any of a microprocessor 702 (FIG. 33, FIG. 34) or signal processing circuitry 704 (FIG. 33, FIG. 34). The printed circuit board (PCB) substrate 14 seen in FIG. 30 comprises a first side 622*a* and a second side 622*b* opposite the first side 622*a*, wherein the exemplary enhanced antenna 12 seen in FIG. 30 may preferably be fabricated on a single side 622, e.g. 622*a* or 622*b*, of the PCB 14.

The enhanced on board PCB antenna 12 seen in FIG. 31 comprises a first electrically conductive monopole structure 20, such as for operation in a first frequency band, e.g. 800 MHz, an electrically conductive L-shaped monopole antenna 26, such as for operation in a second frequency band, e.g. 2.5 GHz to 2.7 GHz, and third electrically conductive monopole structure 30, such as for operation in a third frequency band, e.g. 700 MHz. A slot 29 is defined between the first monopole structure 20 and the second L-shaped monopole structure 26, wherein the slot 29 provides resonance for the 1.7 to 2.2 GHz band. A gap 37 is defined between the L-shaped monopole antenna 26, e.g. such as at the feed point 28, and the electrically conductive trace 32 associated with the third monopole structure 30, wherein the gap may preferably be configured to create adjunction resonance at 700 Hz to 800 MHz.

As seen in FIG. 32, the electrically conductive meander line 22 extends from the monopole structure 20 to a ground point 24, which allows miniaturization of the antenna 12. One or more gaps 25 are defined by the electrically conductive meander line 22, such as to allow tuning for any of inductance or capacitance. In a current embodiment of the enhanced antenna 12, one or more gaps 25 of about 0.5 mm are provided, although other gaps may preferably be used.

As also seen in FIG. 32, the electrically conductive meander line 32 extends from the third monopole structure 30 to a ground point 34, which allows further miniaturization of the antenna 12. One or more gaps 35 are defined by the electrically conductive meander line 22, such as to allow tuning for any of inductance or capacitance. In a current embodiment of the enhanced antenna 12, one or more gaps 35 of about 0.5 mm are provided, although other gaps may preferably be used.

As additionally seen in FIG. 31 one or more electrically conductive slots 40, e.g. 40*a*-40*j*, may preferably be established and preserved 662 for the enhanced on board PCB antenna 12, such as for post-production tuning or for other applications. As desired, one or more of the slots 40 may controllably be kept, modified or removed, e.g. mechanically or by etching, to tune the performance of the assembly.

Exemplary Devices and Systems Having Enhanced Antennas.

FIG. 33 is a simplified schematic view of an exemplary single-input single-output (SISO) wireless device having an enhanced on board PCB antenna 12. FIG. 34 is a simplified schematic view of an exemplary multiple-input multiple output (MIMO) wireless device having an enhanced on board PCB antenna 12.

As seen in FIG. 33, the enhanced antenna may readily be used with a single-input single-output (SISO) device 700, such as to send and/or receive signals 706. The enhanced antenna 12 may typically be connected through signal processing circuitry 704 to a controller 702, e.g. such as comprising or or more processors.

Similarly, as seen in FIG. 34, a multiple-input multiple output (MIMO) wireless device 720 may be configured for a plurality of channels 722, e.g. 722*a*-722*e*, wherein each channel 722 may comprise corresponding signal processing circuitry 704, e.g. 704*a*-704*e*, and enhanced one or more antennas 12, to send and receive MIMO signals 700, e.g. 706*a*-706*e*.

Figure 35:
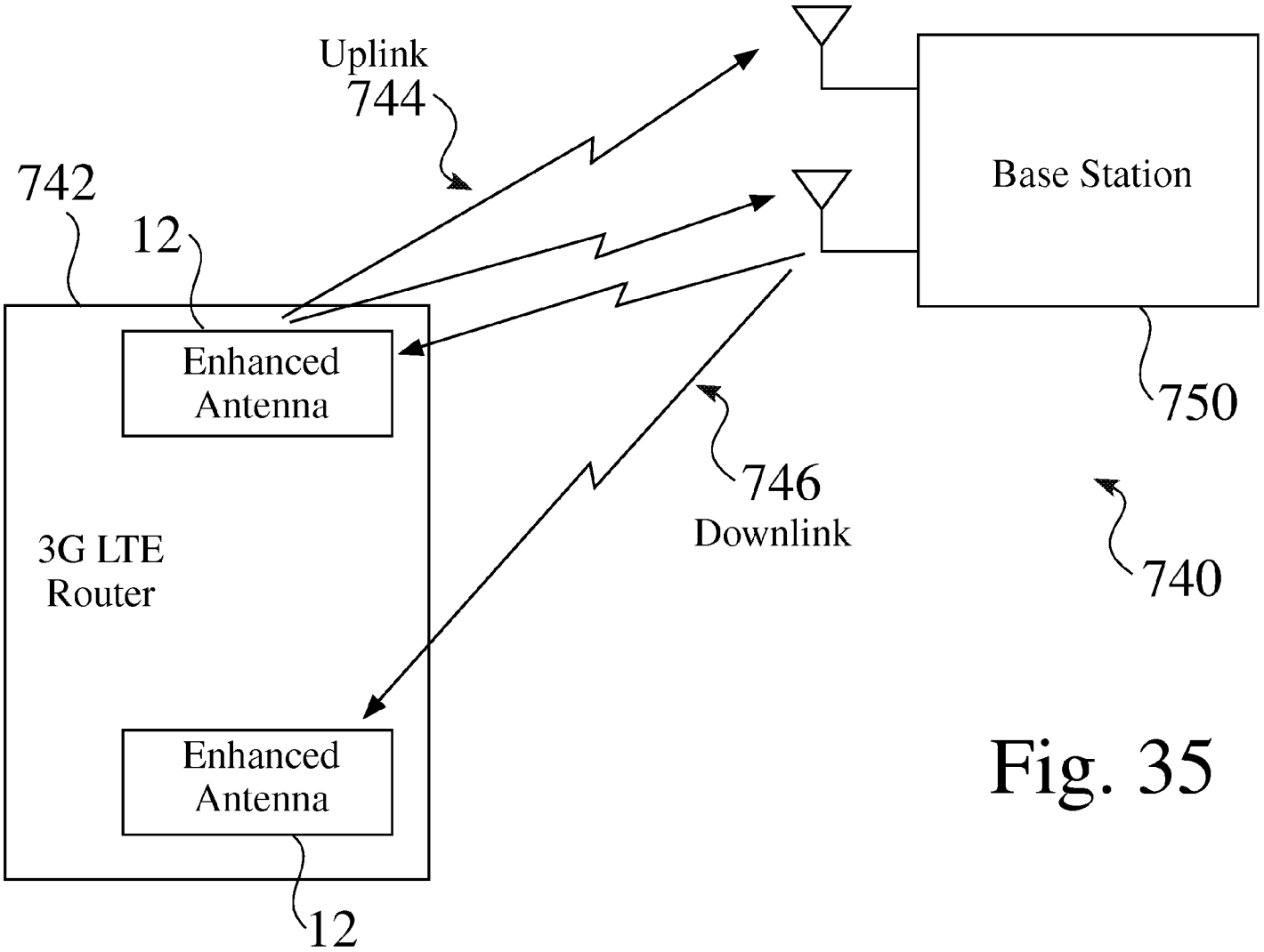
FIG. 35 is a simplified schematic view of an exemplary enhanced router comprising one or more enhanced antennas in communication with a base station.

FIG. 35 is a simplified schematic view 740 of an exemplary enhanced router 742 comprising one or more enhanced antennas 12 in communication with a base station 750. As seen in FIG. 35, an enhanced 3G LTE router may comprise a first enhanced antenna 12 to send uplink signals 744 toward a base station 750, and a second enhanced antenna 12 to receive downlink signals 746 from a base station 750.

Performance Improvements Based Upon Mounting.

Another aspect of the invention, from a manufacturing point of view, provides for a spaced mounting of the enhanced antenna 12. Rather than mounting the enhanced antenna 12 directly to an enclosure, for example by sticking the enhanced antenna 12 directly to the enclosure, the enhanced antenna 12 may preferably have one or more mounting openings 15 that mate with complementary plastic bosses formed into the enclosure. During manufacturing of a device that includes the enhanced antenna 12, the enhanced antenna 12 may preferably be friction mounted into the boss, and permanently held down at that location. Thus, no glue or other adhesive, or fastener may be required to secure the enhanced antenna 12 to the enclosure. Significantly, most commonly used enclosures are all black in color. When the plastic color is changed to black, there is a carbon content increase phenomenon. When the antenna is stuck to the plastic directly, there is a loss in antenna efficiency, where the signal to and from the antenna is absorbed because a black plastic enclosure has a high carbon content. The amount of signal absorbed by the enclosure can be up to 5 to 10 percent if the antenna is mounted directly to the plastic enclosure versus lifting the antenna around five mm or so from the plastic. Thus, with the use of the herein enclosed mounting technique it is possible to get up to 5 to 10 percent efficiency increase.

Although the invention is described herein with reference to the preferred embodiment, one skilled in the art will readily appreciate that other applications may be substituted for those set forth herein without departing from the spirit and scope of the present invention. Accordingly, the invention should only be limited by the Claims included below.

The invention claimed is:

1. An antenna, comprising:

a substrate;

a first electrically conductive antenna structure formed on the substrate, wherein the first electrically conductive antenna structure comprises a monopole antenna having a first electrically conductive trace extending therefrom to a corresponding ground point, and wherein the first electrically conductive antenna structure is configured to operate in a first frequency band;

a second electrically conductive antenna structure formed on the substrate, wherein the second electrically conductive antenna structure comprises a L-shaped monopole antenna and extends to a feed point, and wherein the second electrically conductive antenna structure is configured to operate in a second frequency band; and a third electrically conductive antenna structure formed on the substrate, wherein the third electrically conductive antenna structure comprises a monopole antenna having a second electrically conductive trace extending therefrom to a corresponding ground point, and wherein the third electrically conductive antenna structure is configured to operate in a third frequency band;

wherein a slot is defined between the first electrically conductive antenna structure and the second electrically conductive antenna structure, wherein the slot provides resonance in a fourth frequency band; and wherein a gap is defined between at least a portion of the second electrically conductive antenna structure and at least a portion of the second electrically conductive trace, wherein the gap provides resonance between the first frequency band and the third frequency band.

2. The antenna of claim 1, wherein the substrate comprises any of a printed circuit board (PCB), a glass reinforced epoxy laminated sheet, a ceramic laminate, thermoset ceramic loaded plastic, or a liquid crystalline circuit material.

3. The antenna of claim 1, wherein the first frequency band comprises an 800 MHz frequency band.

4. The antenna of claim 1, wherein the second frequency band comprises a 2.5 GHz to 2.7 GHz frequency band.

5. The antenna of claim 1, wherein the third frequency band comprises a 700 MHz frequency band.

6. The antenna of claim 1, wherein the defined gap is about 0.5 mm wide.

7. The antenna of claim 1, wherein a fourth frequency band comprises a 1.7 GHz to 2.2 GHz frequency band.

8. The antenna of claim 1, further comprising:

at least one electrically conductive region located on the substrate proximal and corresponds to the third electrically conductive antenna structure, wherein one or more of the electrically conductive regions are any of preservable, modifiable or removable to tune the performance of the third electrically conductive antenna structure.

9. The antenna of claim 1, further comprising:

at least one electrically conductive region located on the substrate that is proximal and corresponds to the second electrically conductive trace, wherein the at least one electrically conductive region is any of preservable, modifiable or removable to tune the performance of the third electrically conductive antenna.

10. The antenna of claim 1, wherein the first electrically conductive trace comprises a meander line having at least one gap defined between neighboring sections of the meander line, wherein the defined gap is configured for any of inductive tuning or capacitive tuning of the first electrically conductive antenna structure.

11. The antenna of claim 10, wherein the at least one gap defined between neighboring sections of the meander line is about 0.5 mm wide.

12. The antenna of claim 1, wherein the second electrically conductive trace comprises a meander line having at least one gap defined between neighboring sections of the meander line, wherein the defined gap is configured for any of inductive tuning or capacitive tuning of the third electrically conductive antenna structure.

13. The antenna of claim 12, wherein the at least one gap defined between neighboring sections of the meander line is about 0.5 mm wide.

14. The antenna of claim 1, wherein the antenna is configured to cover a first frequency band of 740 MHz to 960 MHz, and a second frequency band of 1,700 MHz to 2,700 MHz.

15. The antenna of claim 1, wherein the antenna is configured to provide a voltage standing wave ratio (VSWR) of less than 3 to 1 below 1,000 MHz, and a VSWR less than 2.5 to 1 above 1,000 MHz.

16. A multiband antenna established on a substrate, comprising:

a first electrically conductive antenna formed on the substrate, wherein the first electrically conductive antenna comprises a monopole antenna having a first electrically conductive trace extending therefrom to a corresponding ground point, and wherein the first electrically conductive antenna is configured to operate in a 800 Mhz frequency band;

a second electrically conductive antenna formed on the substrate, wherein the second electrically conductive antenna comprises a L-shaped monopole antenna and extends to a feed point, and wherein the second electrically conductive antenna structure is configured to operate in a 2.5 GHz to 2.7 GHz frequency band, wherein a slot is defined between the second electrically conductive antenna and the first electrically conductive antenna, wherein the slot provides resonance between 1.7 GHz and 2.2 GHz; and a third electrically conductive antenna formed on the substrate, wherein the third electrically conductive antenna comprises a monopole antenna having a second electrically conductive trace extending therefrom to a corresponding ground point, and wherein the third electrically conductive antenna structure is configured to operate in a 700 MHz frequency band;

wherein a gap is defined between at least a portion of the second electrically conductive antenna and at least a portion of the second electrically conductive trace, wherein the gap is configured to create adjunction resonance between the 700 MHz and 800 MHZ.

17. The antenna of claim 16, wherein the substrate comprises any of a printed circuit board (PCB), a glass reinforced epoxy laminated sheet, a ceramic laminate, thermoset ceramic loaded plastic, or a liquid crystalline circuit material.

18. The antenna of claim 16, wherein first electrically conductive antenna, the second electrically conductive, and the third electrically conductive antenna comprise portions of a single layer formed on the substrate.

19. The antenna of claim 16, wherein first electrically conductive antenna, the second electrically conductive, and the third electrically conductive antenna comprise any of copper, aluminum, silver, gold, tin, or an alloy thereof.

20. The antenna of claim 16, further comprising:

at least one electrically conductive region located on the substrate proximal and corresponds to the third electrically conductive antenna, wherein one or more of the electrically conductive regions are any of preservable, modifiable or removable to tune the performance of the third electrically conductive antenna.

21. The antenna of claim 16, further comprising:

at least one electrically conductive region located on the substrate that is proximal and corresponds to the second electrically conductive trace, wherein the at least one electrically conductive region is any of preservable, modifiable or removable to tune the performance of the third electrically conductive antenna structure.

22. The antenna of claim 16, wherein the first electrically conductive trace comprises a meander line having at least one gap defined between neighboring sections of the meander line, wherein the defined gap is configured for any of inductive tuning or capacitive tuning of the first electrically conductive antenna.

23. The antenna of claim 22, wherein the at least one gap defined between neighboring sections of the meander line is about 0.5 mm wide.

24. The antenna of claim 16, wherein the second electrically conductive trace comprises a meander line having at least one gap defined between neighboring sections of the meander line, wherein the defined gap is configured for any of inductive tuning or capacitive tuning of the third electrically conductive antenna.

25. The antenna of claim 24, wherein the at least one gap defined between neighboring sections of the meander line is about 0.5 mm wide.

26. The antenna of claim 16, wherein the antenna is configured to cover 740 MHz to 960 MHz and 1,700 MHz to 2,700 MHz.

27. The antenna of claim 16, wherein the antenna is configured to provide a voltage standing wave ratio (VSWR) of less than 3 to 1 below 1,000 MHz, and a VSWR less than 2.5 to 1 above 1,000 MHz.

28. A device, comprising:

at least one processor;

signal processing circuitry connected to the at least one processor; and an antenna connected to the signal processing circuitry, wherein the antenna comprises a substrate having a first side and a second side, an electrically conductive layer located on any of the first side or the second side of the substrate, and a first antenna formed on the electrically conductive layer, wherein the first antenna comprises a monopole antenna having a first trace extending therefrom to a corresponding ground point, wherein the first antenna is configured to operate in a 800 Mhz frequency band;

a second antenna formed on the electrically conductive layer, wherein the second antenna comprises a L-shaped monopole antenna and extends to a feed point, wherein the second antenna is configured to operate in a 2.5 GHz to 2.7 GHz frequency band, and wherein a slot is defined between the second antenna and the first antenna, wherein the slot provides resonance between 1.7 GHz and 2.2 GHz, and a third antenna formed on the electrically conductive layer, wherein the third antenna comprises a monopole antenna having a second trace extending therefrom to a corresponding ground point, and wherein the third antenna is configured to operate in a 700 MHz frequency band, wherein a gap is defined between at least a portion of the second antenna and at least a portion of the second trace, wherein the gap is configured to create adjunction resonance between the 700 MHz and 800 MHZ.

29. The device of claim 28, wherein the device comprises any of a router, a cell phone, a smart phone, a gaming device, a portable computer, or any combination thereof.

30. A process, comprising the steps of:

providing a substrate having a first side and a second side;

establishing an electrically conductive layer on any of the first side or the second side; and forming a multiband antenna on the electrically conductive layer, wherein the multiband antenna comprises a first antenna, a second antenna, and a third antenna, wherein the first antenna comprises a monopole antenna having a first trace extending therefrom to a corresponding ground point, wherein the first antenna is configured to operate in a 800 Mhz frequency band, wherein the second antenna comprises a L-shaped monopole antenna and extends to a feed point, wherein the second antenna is configured to operate in a 2.5 GHz to 2.7 GHz frequency band, and wherein the third antenna comprises a monopole antenna having a second trace extending therefrom to a corresponding ground point, and wherein the third antenna is configured to operate in a 700 MHz frequency band, wherein a slot is defined between the second antenna and the first antenna, wherein the slot provides resonance between 1.7 GHz and 2.2 GHz, and wherein a gap is defined between at least a portion of the second antenna and at least a portion of the second trace, wherein the gap is configured to create adjunction resonance between the 700 MHz and 800 MHZ.

* * * * *